US005983165A

United States Patent [19]

Minnich et al.

[11] Patent Number: 5,983,165

[45] Date of Patent: Nov. 9, 1999

[54] ACCELEROMETER-BASED MONITORING OF CONCRETE CONSOLIDATION

[75] Inventors: James R. Minnich, Ashland; Lloyd R. Mawhorr, Shelby, both of Ohio; Neil E. Schipper, Winnepeg, Canada

[73] Assignee: Minnich/ Maginnis Mfg. Co., Inc., Mansfield, Ohio

[21] Appl. No.: 08/869,107

[22] Filed: Jun. 4, 1997

[51] Int. Cl.[6] ..... F01C 19/38

[52] U.S. Cl. ..... 702/56; 702/141; 364/528.15; 404/117; 404/115

[58] Field of Search ..... 702/56, 43, 141, 702/142, 163, 169; 404/84.1, 84.05, 117, 115; 364/528.15; 73/660, 593, 594

[56] References Cited

U.S. PATENT DOCUMENTS 5,177,415 1/1993 Quibel et al. ..... 702/163
5,492,432 2/1996 Eben et al. ..... 404/115
5,719,338 2/1998 Magalski ..... 404/117
5,727,900 3/1998 Sandstrom ..... 404/84.05

*Primary Examiner*—Kamini Shah
*Attorney, Agent, or Firm*—Muller and Smith, L.P.A.

[57] ABSTRACT

A concrete paving system of a variety employing an array of vibrators which consolidate dispersed concrete over a roadbed or the like as the concrete is introduced to the mouth of a slipform pan or mold. The rate of vibration of these vibrators is monitored utilizing an accelerometer in conjunction with a vibration conversion network treating the acceleration signals to deriving vibration rate data which is published for each vibrator at a display. A controller with the system provides for the development of upper limit and lower threshold alarm limits which may be displayed along with audible warnings. Such vibration transducer based monitoring system also may be used for rotational component performance monitoring as well as in conjunction with probes located within distributed concrete in the vicinity of the array of consolidation vibrators to evaluate the performance of the latter. The monitoring system also is employable with the vibratory components of dowel bar insertion assemblies.

25 Claims, 19 Drawing Sheets

POWER SUPPLY
MONITOR
SIGNAL TREATMENT AND VIBRATION ANALYSIS
SIGNAL TREATMENT AND MONITOR COMMUNICATION
SIGNAL TREATMENT AND MONITOR COMMUNICATION
ACCELEROMETER
ACCELEROMETER
VIBRATOR FOR DISPENSED CONCRETE
VIBRATOR FOR DISPENSED CONCRETE
254
308
310
312
266
264
268
258
306a
306b
306i
306j
190a
190j
304a
304j
130a
130j
72a
72j

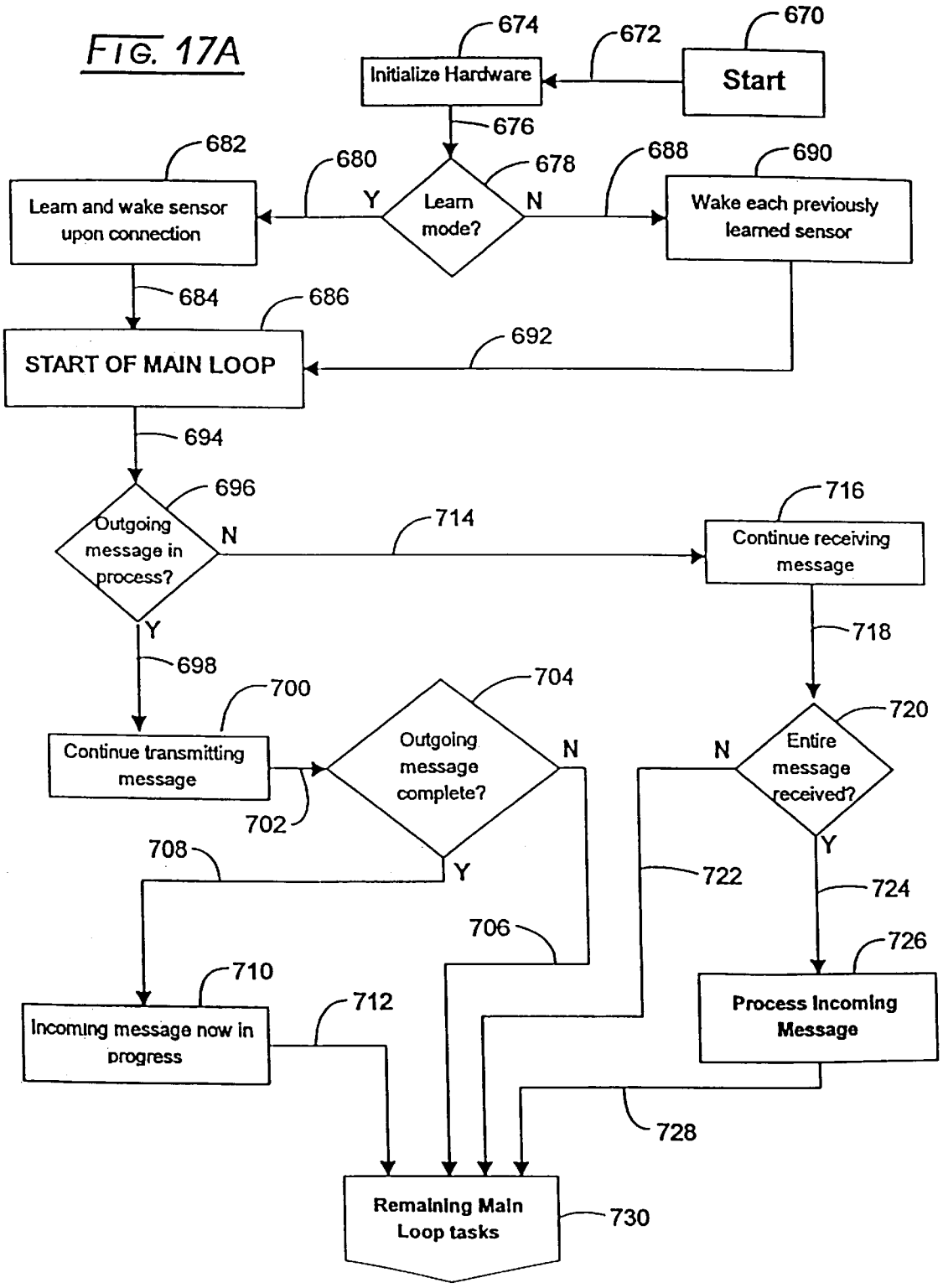
FIG. 17A
Start
670
672
Initialize Hardware
674
676
Learn mode?
678
Y
N
680
682
Learn and wake sensor upon connection
688
690
Wake each previously learned sensor
684
686
START OF MAIN LOOP
692
694
Outgoing message in process?
696
N
714
Continue receiving message
716
Y
698
718
Continue transmitting message
700
Outgoing message complete?
704
702
N
Y
Entire message received?
720
N
Y
708
722
724
706
726
Incoming message now in progress
710
712
Process Incoming Message
728
Remaining Main Loop tasks
730

ACCELEROMETER-BASED MONITORING OF CONCRETE CONSOLIDATION

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The technology for constructing current-age crushed stone-based roadways and pavements has progressed, for example, from the multi-size stone-based roadways of Macadam in the early 19th Century to the highly mechanised paving industry of today using stone-based mixtures in combination with binders such as cementious or organic material. Paving technology with concrete mixtures historically has evolved with improved cement formulations and working tools. These tools have functioned to consolidate concrete mixes, for example by vibration to remove air pockets or voids while retaining requisite air entrainment. Additionally, tools have been evolved to cause concrete mixes of design varying plasticity to conform to the boundary-defining constraints of a mold. Further, tools and associated structures have been developed to form a specified surface texture and appearance of a given pavement. Process efficiencies for producing concrete paving commenced to be substantially enhanced in the mid-1950's with the initial development of the slipform paver.

The slipform paver is a driven track mounted platform functioning as a dynamic mold which moves over site-or roadbed deposited concrete in the manner of a moving extruder to form continuous pavement. To carry out this molding process, a process scheme involving a linear sequence of stages is involved which, in part, emulates a working combination of earlier concrete working tools. In this regard, an initial stage of the slipform machinery continuously spreads the newly mixed plastic concrete mass before molding stages, whereupon energy is applied to this incompressible distributed mass in the course of treatment to mold a pavement.

Energy application to the concrete mass involves the dynamic contributions of vibration, squeeze or pressure, and mold surface movement. All of these energy related contributions are associated or interact with the mix attributes of the concrete itself, which not only are the product mix formulation, but also may be subject to the logistic vagarires of concrete supply and delivery. Any changes in these variables without accommodation in the process may well affect paving results either positively or negatively.

The consistency of a concrete mix generally is a function of its specified formulation or design. Mix plasticity typically is measured by the classical slump evaluation. For the process of slipform machine molding of concrete, consistency as developed from formulations and/or molding dynamics is highly important in the achievement of paving success. As a preliminary aspect, the slump of a mix must be low enough to produce sharp and stable pavement edges, yet the mix must respond well to the extrusion process and consolidate properly. Currently, concrete mixes intended for slipform paving will exhibit a one to two inch slump to meet these requirements.

The concrete forming dynamics of the slipform molding procedure generally commence following the spreading of concrete which has been deposited on a prepared roadbed Spreading conventionally is accomplished, inter alia, with a rotating, horizonally disposed auger, often performing just forwardly in the process line from a horizontally disposed metering or strike-off component A volume of concrete thus is disposed extending across the roadbed within a region sometimes referred to as a "grout box". It is at this position in the continuous extrusion process that the concrete mass is confronted by the extrusion envelope, the crucial point where machine performance essentially determines the quality of the final product. At this location, the concrete mass is treated by internal vibration which is induced into the mix by an array of hydraulically driven vibrators, the vibrational components of each of which typically are mounted within a case of cylindrical cross-section. Aligned in parallel with the path of pavement formation, the vibrators preferably are mounted at an elevation over the roadbed representing about the mid point or center of the thickness of the ultimately created pavement. Generally implemented as a rotational, hydraulically driven eccentric, the vibrator generates frequencies in a range of about 9,000 to 10,500 rpm or vpm (vibrations per minute).

These internal (within the concrete mass) vibrators serve two critical purposes in the pavement molding process: to consolidate the concrete mass by removing undesirable voids; and to fluidize the material to an extent facilitating paver slip mold movement over and through the concrete mass. In effect, an individual intra-aggregate particle friction reduction permits the "slipping" required for the slipform process. Such fluidization also functions to enhance a uniformity of pressure of the mix at the confronting nose or entrance of the slip mold. In this regard, intra-aggregate particle friction is reduced by this fluidization at the process location where the concrete is sheared off at its proper molded elevation by the nose or front of the profile pan or mold. Changes in pressure at this confronting point will cause the slipform machine to compensate by lifting or diving. Since the profile pan cannot compensate adequately for large changes in pressure at the nose, a non-uniform surface and non-uniform consolidation may be the deleterious result. Further, the angle at which the nose of the profile pan shears concrete, also known as the angle of attack, is of importance in this molding process. Inasmuch as mix characteristics will determine how much energy the machine needs to inject into the concrete to successfully complete the extrusion process, the best angle of attack will be different for different concrete mixes. Some slipform paver configurations also will incorporate a tamper bar just in front of the nose of the pan or mold. This tamper bar functions to carry out a secondary consolidation on the concrete mix and aids in the performance of the profile pan by moving large aggregates to just below the pavement surface at this critical shear point. The thin layer of mortar created by the tamper bar at the surface between the concrete and the profile pan lowers friction between the mold and the concrete to aid in the overall molding process.

From the foregoing, it may be observed that the performance of the arrayed vibrators within the slipform process is of substantial importance. Investigators of this aspect of the dynamic molding process have determined that each of the vibrators of the submerged or invested array creates a conically-shaped zone of influence. The extent of this zone changes as the level of energy, correlated with frequency or vibrations per minute (vpm) changes. An increase in the frequency of vibration tends to widen the zone, while a corresponding decrease narrows it. The vibration energy level required for a particular mix design and depth of placement may require changing the number of vibrators in the array and operating them at higher or lower energy levels. In mounting the vibrators in the noted array across the nose or opening of the mold, spacings of each vibrator are set on what is speculatively anticipated as a slight overlap of each conical zone of influence. Typical vibrator spacings on slipform paving machines range from 12 to 24 inches. Those vibrators which are located next to the edges of the mold typically are set approximately six inches from each side form of the machine and to achieve an optimum orientation of the noted cone of influence. The cylindical housings of the vibrators, the surfaces of which are in contact with the concrete, are set in a somewhat horizontal orientation. As is apparent, the height of concrete over the vibrators evokes a hydrostatic head. Any changes in the head will develop concrete pressure changes to affect the attributes of vibration and slipform paver machine performance. Thus, the array of vibrators provides an important aspect of the energy application to the concrete mix within the slipform process and, as is apparent, an ongoing evaluation of the performance of the vibration function is an important operational parameter in achieving a successfully molded pavement product.

Traditionally, the quality of vibrator performance and attendant concrete paving quality has been predicated upon the experience and skill of the slipform machine operator. These operators, relying on their experience, control such dynamic parameters as machine speed and the rotational speed of the consolidation vibrators. Generally, the operator has performed under the assumption that all vibrators in an array are operating at any given time, at the same rotational rate. Rotational speed deviation or vibration stoppage has been discerned generally with the ear and eye of the operator who stands in the midst of the rigorous ambient environment of the slipform paver. These vibrator rotational rates must be established to effectively remove entrapped air voids while maintaining an air entrainment of about 6% of the mass volume of the concrete. The latter air entrainment is a mix design feature for accommodating ambient weather-temperature variations as the pavement is utilized over its lifespan. Where the applied vibrational energy is inadequate, a key aspect of the slip molding process is lost with product degradation. On the other hand, where applied vibrational energy is excessive, a disassociation of the important mix of different aggregate size occurs, the larger stone being driven from the vibration region. This mix discontinuity contravenes industry teaching reaching at least as far back as Macadam. More specifically, as the vibrator is moved through a concrete mix, it creates a hole in its orbit Should the slump of the concrete be too greatly reduced by energy induced therein, the adjacent material will not fill the hole left behind the orbiting vibrator and consolidation is compromised. The phenomenon now is known as "post-holing". Typically, the resultant void then is filled with smaller aggregates and the mix discontinuity has been observed in the finished pavement as longitudinal visible texture changes or markings referred to in the industry as "vibrator trails". Recent investigation of this phenomenon has revealed that the trails exhibit the noted mix discontinuity with an absence of larger aggregate components and a tendency to early pavement deterioration.

Individual vibrator breakdowns generally have been discerned by observing the external affect on the mix or by hearing a vibrator bearing deteriorate. Rotational speed variations of the eccentrics of the vibrators are difficult to observe or hear and, thus for some industry participants, tachometers have been employed to monitor vibrator speeds to aid the operator in discerning performance vagaries.

Over the recent past, additional vibration systems have been incorporated within slipform paving machinery. Traditionally, periodically positioned expansion joints have been created in concrete pavement by placing preassembled reinforcing rod "baskets" across the roadbed at joint locations ahead of the paving process. The pavers then encountered and paved over these assemblies, whereupon expansion joints were formed over them. Important production cost reduction has been realized through the utilization of a dowel bar inserter which is mounted upon the paving machine. In general, a plurality of reinforcing bar dowels are loaded within a distribution component mounted upon the machine, which dowels are engaged by a placement mechanism and inserted down within the formed paving in parallel, horizontally and at given lateral spacing, for example upon 18 inch centers. In general, the procedure is designed such that the dowels are positioned in a manner providing for no relative movement between the dowels and the pavement during their placement Metal forks mounted in a hydraulically powered insertion frame are used for such positioning. As the insertion sequence progresses, the dowels are released to the surface of the pavement, held in horizontal position by spacer plates and hydraulically implanted in the concrete. Vibration is added as the forks engage the dowels and penetrate the concrete. The dowels then are released at the proper elevation in the concrete structure and the forks then retract. As the forks retract, vibration is induced to close the hole created by the penetration and reconsolidate concrete surrounding the dowel. It is important that the dowels be located in parallel alignment with the longitudinal extent of the pavement and remain in a horizontal orientation, a feature not always accomplished. Further, the reconsolidation procedure must not be deleterious to the mix structure. As is apparent, a control over the vibratory aspects of this dowel insertion technique is of paramount importance. Of course, the optimization of the insertion of vibration energy is important for any aspect of concrete placement including the use of hand-held mix vibrating devices.

As may be apparent, although many advances have been made in the slipform paving machines since their introduction in the 1950's, much improvement in their performance and operation is called for. Such improvements necessarily must look to the somewhat delicate balance of concrete mix design, delivery, vibration dynamics, linear machine speed, and machine geometry adjustments.

BRIEF SUMMARY OF THE INVENTION

The present invention is addressed to a system, method, and apparatus for improving the performance of mechanized concrete paving systems. Vibrator arrays mounted upon slipform pavement machines are monitored by vibration transducers which not only provide data as to vibration rates such as vibrations per minute (VPM), but also offer signal contained data with respect to the performance of those moving components constituting the vibrators themselves. Analysis of the typically rotating eccentric based devices is available from vibration signals gleaned in situ, i.e. while the vibrators are immersed within distributed concrete located before the mouth of a slipform pan or mold.

Control features incorporated with this system and method provide for the generation of alarm conditions with respect to lower thresholds of vibratory rates, as well as to high limits of vibratory rates, the former addressing insufficient concrete consolidation and the latter addressing disassociative effects manifested as vibrator trail phenomena. Alarm conditions are suppressed by logic control during start-up and shut-down procedures. The monitoring control arrangement permits the advantageous use of data log features and the like wherein a variety of extrinsic pavement production conditions such as calendar/time data, ambient temperature, humidity, paver speed and the like may be recorded for subsequent analysis.

In addition to the monitoring features of the invention which are associated with concrete consolidation, the system is readily adapted to the monitoring of external vibratory components such as the vibrators mounted upon dowel bar insertion (DBI) assemblies. Such monitoring functions to improve the assurance of quality in the important placement of these load bearing components within freshly molded pavement As a further feature of the invention, vibration transducer containing probes are employed within distributed concrete in spaced adjacency with the consolidation vibrators of the pavers. This permits the generation of consolidation analysis signals providing information as to the quality of performance of the consolidation deriving vibratory components. For all monitoring systems, the vibration transducer of choice is an accelerometer. The acceleration designated signals which may be derived from such transducers may, for example, be integrated to derive vibration velocity signals and further integrated to evolve vibration displacement signals. All such data may then available to machine and process performance analysts by memory downloading procedures.

Another feature of the invention is to provide, in a concrete paving system, wherein a supporting frame is moved along the path over which concrete pavement is to be formed, having a spreading mechanism supported by the frame confronting supplied concrete for providing distributed concrete, the system further including spaced-apart vibrators from first to last supported by the frame and each exhibiting a given period of vibration which are located within the distributed concrete to provide consolidated concrete, a mold apparatus supported by the frame for receiving the consolidated concrete, and providing molded concrete, the improvement which comprises:

Accelerometers from first to last respectively mounted in vibration transfer relationship with respective vibrators from first to last, and having respective first to last acceleration signals corresponding to the vibration exhibited by a vibrator with which each is operationally mounted. A vibration conversion network is provided which is coupled for response to the first to last acceleration signals for deriving respective first to last conversion outputs corresponding with the given periods of vibration. A monitor assembly including a monitor controller is mounted upon the frame and is responsive to the conversion outputs for deriving rate output signals from first to last corresponding, respectively, with the rate of vibration of each vibrator from first to last and a display is incorporated with the monitor assembly which is responsive to the rate output signals for providing a visual readout corresponding therewith.

Another feature of the invention is to provide a method for monitoring the performance of a concrete paving system wherein a frame is moved along a path over which concrete pavement is to be formed, having a spreading mechanism supported by the frame confronting supplied concrete for providing distributed concrete, spaced apart vibrators from first to last supported by the frame, and each such vibrator exhibiting a given period of vibration, the vibrators being located within the distributed concrete to provide consolidated concrete, a mold apparatus is included in the system which is supported by the frame for receiving the consolidated concrete and providing molded concrete, the method comprising the steps of:

providing vibration responsive transducers from first to last respectively mounted in vibration transfer relationship with respect to ones of the vibrators from first to last and having respective first to last transducer signals corresponding to a select vibration parameter exhibited by a vibrator with which each is operatively associated;

providing a conversion network coupled for response to the first to last transducer signals for deriving respective first to last conversion outputs corresponding with the given periods of vibration;

deriving first to last rate output signals respectively corresponding with the first to last conversion outputs; and displaying a readout of first to last vibration rate values corresponding with the first to last output signals.

As a further feature, the invention provides a concrete paving system wherein a supporting frame is moved along a path over which concrete pavement is to be formed, the paving system having a spreading mechanism supported by the frame which confronts supplied concrete for providing distributed concrete;

spaced apart vibrators from first to last are provided, each of which incorporates bearings mounting a rotational eccentric driven by a seal containing hydraulic drive assembly. Each of the vibrators exhibits a given period of vibration and is located within the distributed concrete to provide consolidated concrete. A mold apparatus is supported by the frame and functions to receive the consolidated concrete and provides molded concrete. The improvement to the system comprises vibration transducers from first to last respectively mounted in vibration transfer relationship with respective vibrators from first to last and which have first to last transducer signals corresponding to the vibration exhibited by the vibrators with which each is associated. A conversion circuit is coupled for response to the first to last transducer signals for deriving respective first to last conversion outputs corresponding with a given period of vibration. A monitor assembly is provided which includes a monitor controller mounted upon the frame which is responsive to the conversion outputs for deriving rate output signals from first to last respectively corresponding with the rate of vibration of each vibrator from first to last. The controller further is responsive to derive an alarm condition when a rate output signal exhibits an alarm value less than a predetermined threshold value.

Further, the monitor assembly includes a display which is responsive to the rate output signals and to the occurrence of the alarm condition for providing visual readouts corresponding therewith.

Other objects of the invention will, in part, be obvious and will, in part, appear hereinafter.

The invention, accordingly, comprises the system, method, and apparatus possessing the construction, combination of elements, arrangement of parts, and steps which are exemplified in the following detailed description.

For a fuller understanding of the nature and objects of the invention, reference should be had to the following detailed description taken in connection with the accompanying drawings.

BRIEF DESCRIPTION OF THE DRAWINGS

FIGS. 17A and 17B are a flow chart of a program which may be employed with the invention.

DETAILED DESCRIPTION OF THE INVENTION

Figure 1:
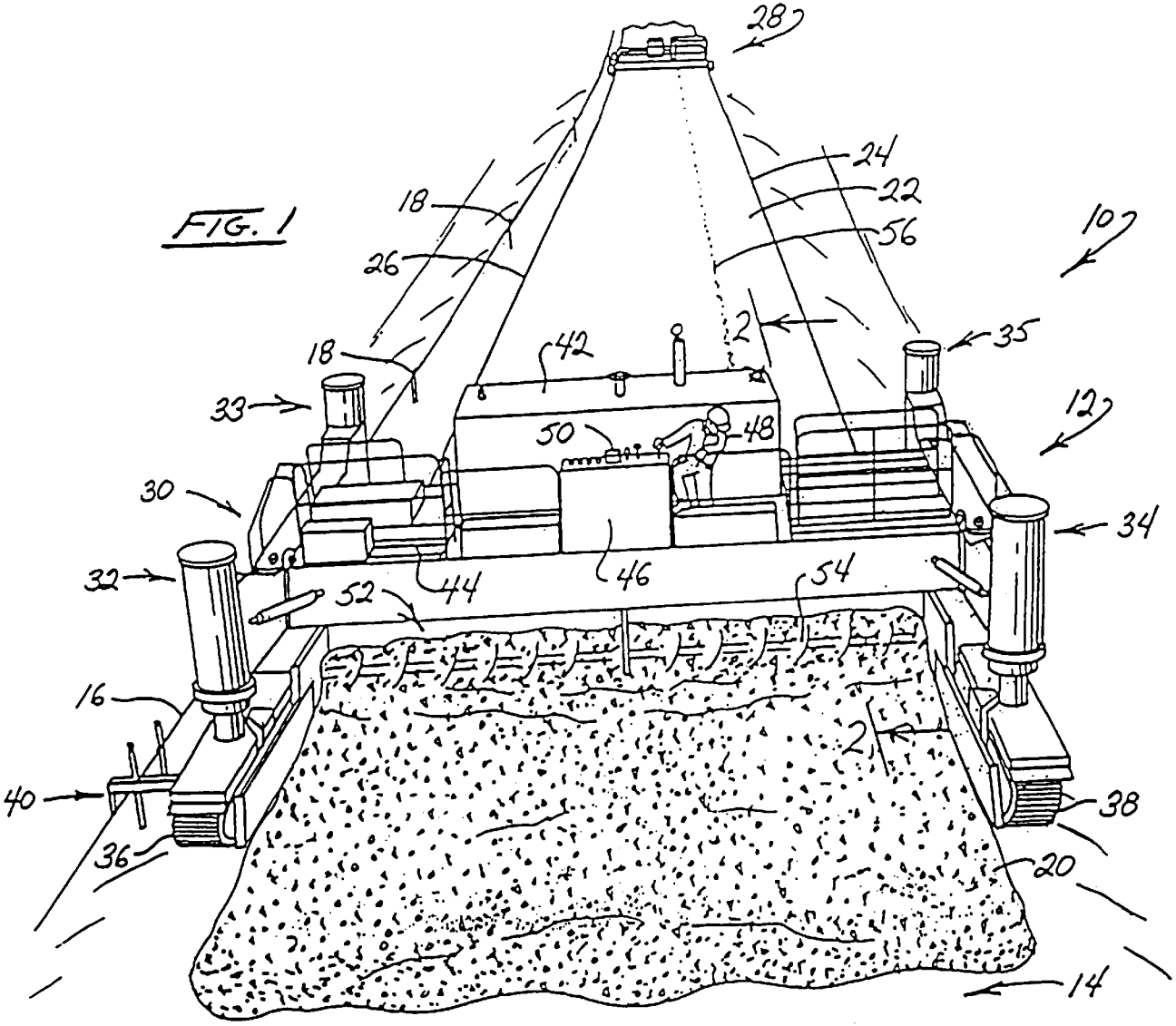
FIG. 1 is a pictorial view of a slipform paver machine in operation along a roadbed, the figure further showing a curing apparatus trailing the paver machine.

The concrete paving system with which the instant invention is particularly adapted for use may take on a variety of forms. However, most slipform paver machines are designed having certain universal components which are employed for crying out the slipform paving process, for example, forming roadway or runway pavement. The former application for roadway construction is illustrated in the figures. Referring to FIG. 1, a paving system is represented generally at 10 which is shown to comprise a slipform paving machine represented generally at 12 which is seen to be moving over a prepared road bed 14 alongside of which there is provided a somewhat continuous alignment and indexing line 16 supported by stakes as at 18 a given elevation above the road bed. In its overall operation, the slipform paving machine 12 confronts a supply of pre-mixed and deposited concrete 20 as it moves along a path defined by the road bed and indexing line 16. The machine 12 employs a form of a moving extrusion molding process to continuously form a pavement or slab 22 between defined edges 24 and 26. The slab, upon being cured, will provide a lane of highway. Rearwardly of the machine 12 in the sense of its forward movement, there follows a concrete curing machine represented generally at 28.

Looking particularly to the slipform paver machine 12, it may be seen to comprise a frame represented generally at 30. Frame 30 is supported upon four endless track implemented prime mover assemblies represented generally at 32–35. Assemblies 32–35 are hydraulically driven and are maneuverable so as to adjust the elevation of the frame 30 over the road bed 14 for essentially all paving situations generally encountered. The tracks employed with the assemblies 32–35 are maneuverable in a direction to an extent of at least 90° and two such tracks for assemblies 32 and 34 are shown in the instant figure, respectively, at 36 and 38. An indexing and alignment association between the paver machine 12 and the line 16 is shown by an outrigger assembly represented generally at 40. The frame 30 supports a power source 42 typically comprising an internal combustion engine with associated battery and the like, and a hydraulic motor. Adjacent the power source 42 is an operator platform 44 carrying a control console 46 and supporting an operator as represented at 48. Among the operational readouts and control devices mounted upon the console 46 is a monitor with controls and readout representing a component of the instant invention and shown at 50.

In its general operation, the frame 30 of the machine 12 supports a spreading mechanism represented generally at 52 which includes such components as an auger represented generally at 54. The spreading mechanism 52 functions to spread the supplied concrete 20 at a predetermined elevation along the road bed 14 to develop a forward region providing distributed concrete to the components which follow, including vibratory devices and slipform mold. In general, the vibrators will be arranged in a parallel array, for example, of up to 16 devices which extend across the road bed 14. In the event of a malfunction, for example, of excessive vibration, phenomena such as vibrator trails may develop in the produced pavement, one of which is represented for illustrative purposes only at 56 at the pavement surface 22. Such trails at 56 represent a highly undesirable aspect of the paving process.

Figure 2:
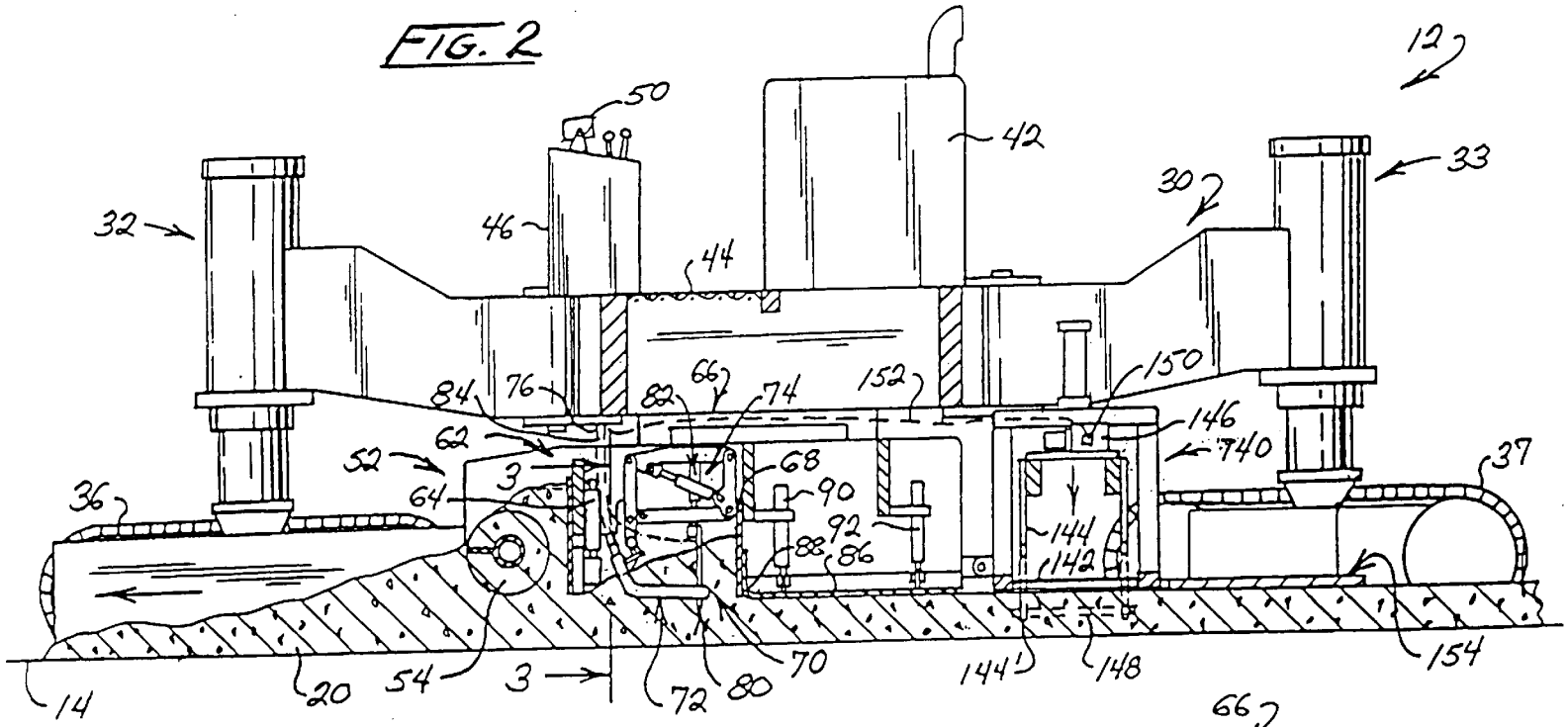
FIG. 2 is a sectional view taken through the plane 2—2 in FIG. 1.

Referring to FIG. 2, the slipform paver mechanism is illustrated. In the figure, slipform paver 12 is seen mounted upon the road bed 14 and is confronting supplied concrete 20 with the auger 54 which is seen positioned forwardly, in the sense of machine movement, of a strike-off plate assembly represented generally at 62. The assembly 62 is seen to be adjustable in elevation over roadway 14 by a hydraulically actuated mechanism 64. The next region encountering the distributed concrete is sometimes referred to as a "grout box" as represented generally at 66. Grout box 66 is defined between the strike-off plate assembly 62 and a tamper bar assembly shown at 68. Note that the distributed concrete is built-up somewhat as represented at 70 within the grout box region 66. Located within the grout box region 66 is an array of hydraulically actuated vibrators represented generally at 72, all components of which are supported by a placement mechanism extending across the width of the paver machine 12 and which is represented generally at 74. In accordance with the invention, each component of the vibrator array 72 contains an accelerometer or suitable vibration responsive transducer which provides acceleration or transducer signals corresponding to the vibrations exhibited by such vibrator. These accelerometers and associated local conversion networks provide conversion outputs corresponding with periods of vibration which are submitted to monitoring circuitry at housing 50 by a cable harness represented by the dashed line 76. Also mounted within the grout box region 66 is an array of accelerometer or transducer containing vibration probes represented generally at 80 and which are seen extended from a probe support assembly represented generally at 82. The vibrators within the array 72 provide a consolidation of the concrete within the grout box region 66 and their performance is monitored not only by the accelerometers associated with them but also by the acceleration-based vibration output of the probe array 80. In the latter regard, cables from the probe array 80 are represented at dashed line 84 which will extend to the monitoring circuitry, for example, at housing 50.

Next occurring in the moving slipform paving process is a profile pan 86 having a forwardly disposed nose or shear component 88. Pan or mold 86 is adjustably supported by suspension mechanisms as at 90 and 92. The angle of inclination of the profile pan 86 with respect to forwardly to tearwardly direction in terms of machine movement and the asserted compression from it influences paver uplift and the pan 86 as well as the vibratory and related components within the grout box 82 function to establish an extrusion envelope for evolving pavement formation.

Figure 3:
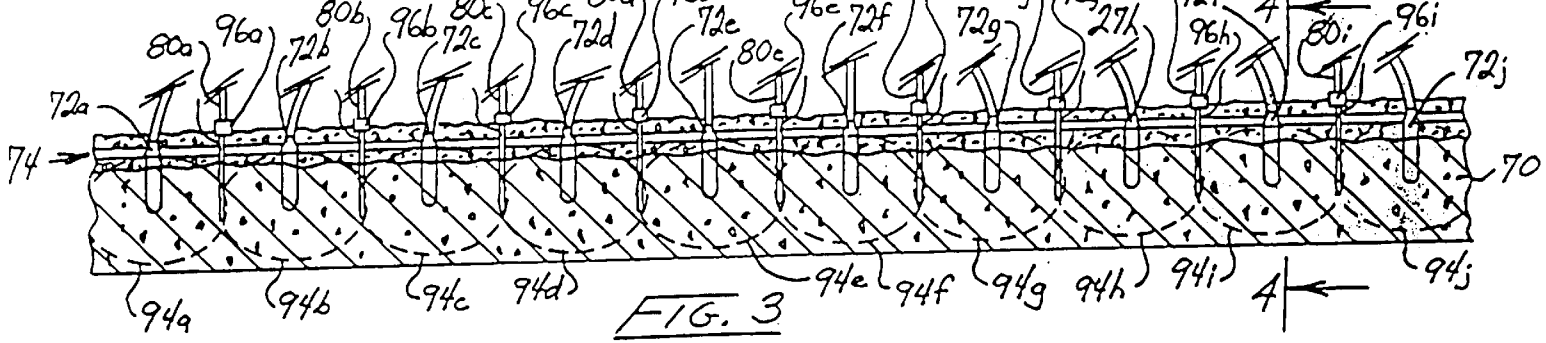
FIG. 3 is a sectional view taken through the plane 3—3 in FIG. 2.

Looking momentarily to FIG. 3, the array of vibrators represented generally at 72 in FIG. 2 is represented in the figure as discrete vibrator components 72*a*–72*j*. Note that the vibrators extend into, i.e. are submerged within the concrete mass or distressed concrete 70 and are supported by the mechanism represented generally at 74 as described in connection with FIG. 2. Each of the vibrators, when in operation, will evolve what has been referred to as a "vibration cone of influence" affecting the consolidation of concrete. Such cones of influence corresponding with the vibrators 72*a*–72*j* are represented in dashed line fashion in FIG. 3 respectively at 94*a*–94*j*. The array of vibration probes 80, as seen in FIG. 2, are positioned rearwardly in terms of movement of machine 12 with respect to the vibrator array 72. These probes are represented in FIG. 3 at 80*a*–80*i* and are seen extend within the concrete mass 70 generally at the anticipated positions of overlap (cross-talk) of the cones of influence 94*a*–94*j*. Additionally, the probes as at array 80 may be utilized to monitor edge effects and the like at the critical edge areas of the concrete mass intended for evolution of the pavement edges 24 and 26 (FIG. 1). The discrete probe components 80*a*–80*i* are seen to incorporate a connector housing which may contain vibration transducers such as accelerometers, as well as any needed signal treating output and input circuitry, and which, respectively, are represented at 96*a*–96*i*. Positioning of accelerometers within a probe component housing will depend upon the requirements of the operator. In this regard, the probes may be fashioned as cylinders with the accelerometers placed therein. Alternately, the accelerometers, as noted, may be positioned within the output housings 96. It may be observed that the consolidated concrete at the location of the probe array 80 is in a plasticized state enhancing the capability thereof to conformance within the slip molding process involving pan 86. Generally, the enhanced elevation of the concrete mass 70 within the grout box 66 is considered to be beneficial to the vibratory action evolved from the vibrator array 72.

Figure 4:
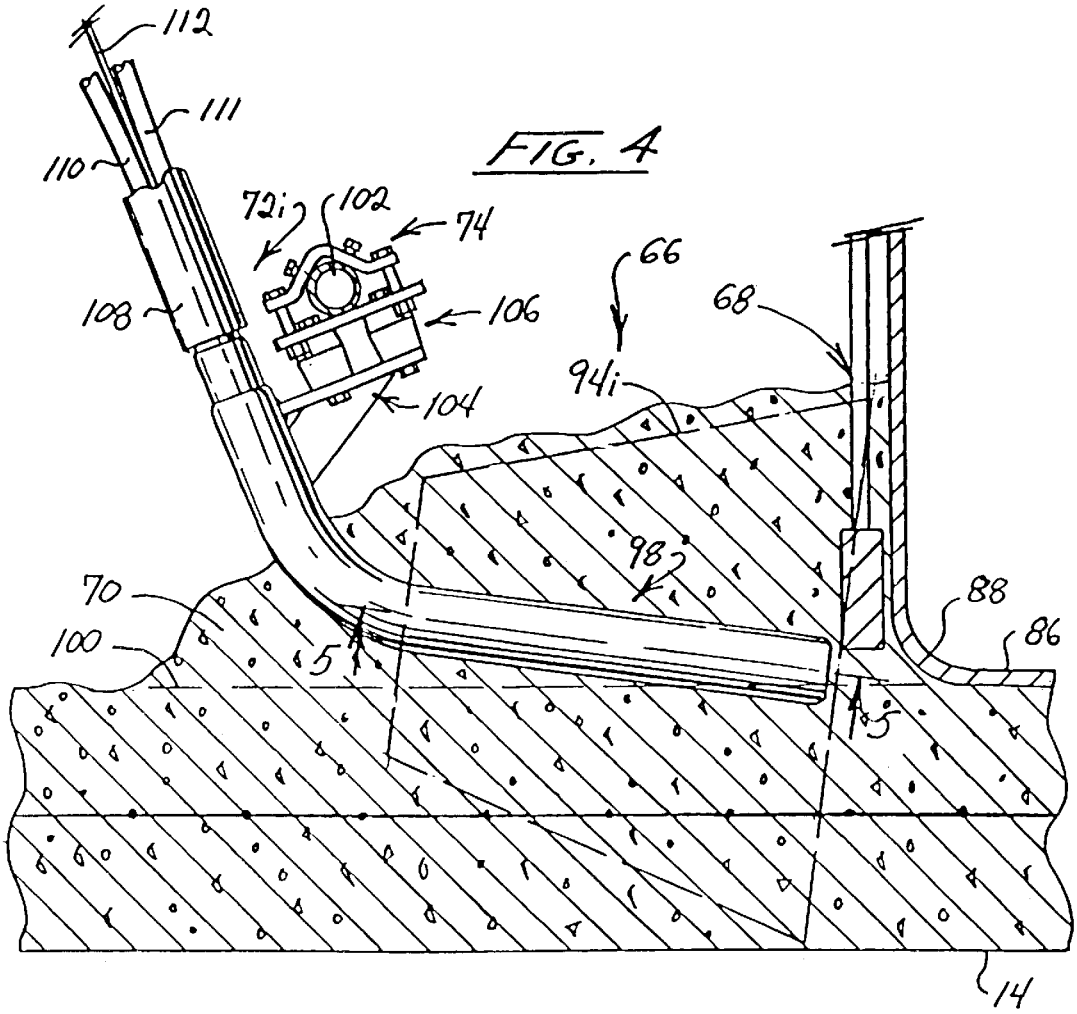
FIG. 4 is a partial sectional view taken through the plane 4—4 in FIG. 3.

Referring momentarily to FIG. 4, the structuring and placement of one of the vibrator components, that described at 72*i*, is revealed in enhanced detail. In the figure, the vibrator 72*i* is seen to have a generally cylindrical configuration which is formed such that the active components of the vibrator within the cylindrical region 98 are horizontal to the road bed 14 or slightly horizontal to that road bed plane or the plane of the ultimately derived pavement surface as represented at dashed line 100. About a 15° inclination of such active component is represented in FIG. 4. The device 72*i* is mounted to the placement mechanism 74 at a horizontally disposed, elongate rod 102 thereof through a bracket assembly 104 and clamp 106. Protective flexible tubing 108 serves to carry two hydraulic lines 110 and 111 as well as an instrumentation cable 112. Shown in the figure is a transverse view of the "cone of influence" earlier described at 94*i*. This, as noted above, is the region of influence of vibration emanating from the region 98 of vibrator 72*i* within the concrete mass 70. The advantage of the larger height of this mass 70 within the grout box region 66 becomes apparent from the drawing.

Figure 5:
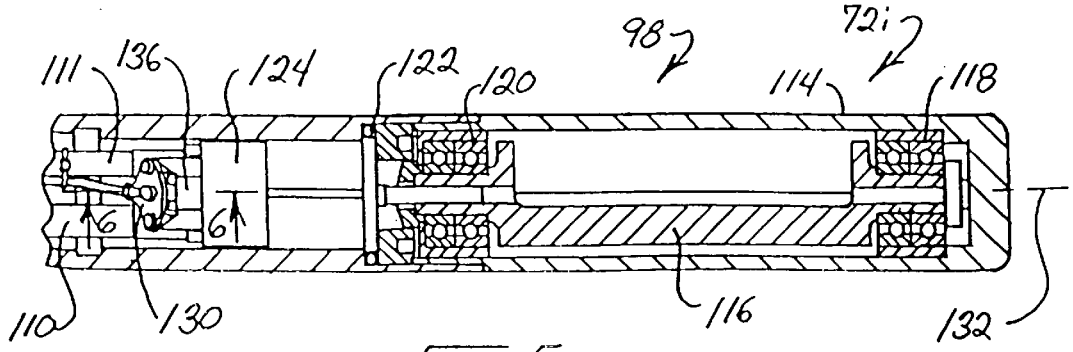
FIG. 5 is a partial sectional view taken through the plane 5—5 in FIG. 4.

FIG. 5 shows a cross-section of the region 98 of vibrator 72*i*. The figure shows device 72*i* to incorporate a steel cylindrical housing 114 within which an eccentric 116 is mounted for vibration inducing rotation. Eccentric 116 is supported at its terminal ends by bearings 118 and 120. This assemblage of eccentric 116 with bearings 118 and 120 is sealed, inter alia, from the incursion of hydraulic fluid at a seal 122. Drive is imparted to eccentric 116 from a hydraulic motor 124 which performs in conjunction with the earlier-noted hydraulic lines 111 and 110.

In accordance with the instant invention, an accelerometer assembly shown generally at 130 is mounted within the cylindrical region 98. Looking additionally to FIG. 6, the accelerometer assembly 130 is seen to be mounted upon a board 132 which, in turn, is mounted upon the angularly oriented surface 134 of an accelerometer mounting bracket 136. Bracket 136, in turn, is mounted by machine screws to the housing 114 by an adapter bar (not shown).

Figure 6:
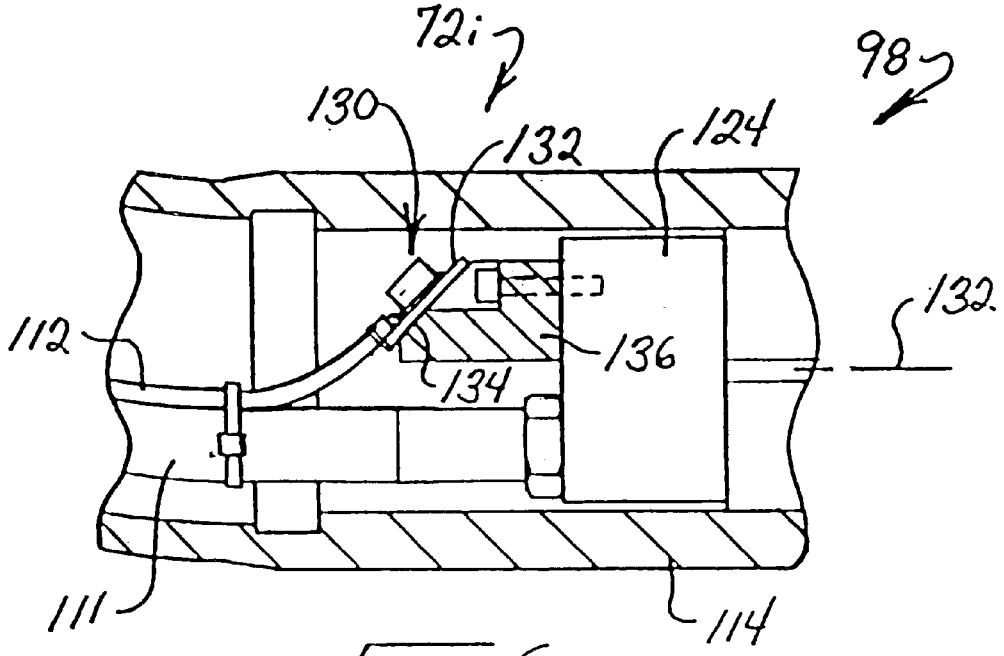
FIG. 6 is a partial sectional view taken through the plane 6—6 in FIG. 5.

The accelerometer may be provided as a model ADXL50monolithic accelerometer with signal conditioning marketed by Analog Devices, Inc. of Norwood, Mass. For such devices, no external active components are required for interfacing directly to microcontrollers or like circuitry. The devices use a capacitive measurement method with an analog output voltage which is directly proportional to acceleration. That output is fully scaled, referenced, and temperature compensated to provide a linearity over the noted temperature range. The internal circuitry of the device implements a forced-balance control loop that improves accuracy by compensating for any mechanical sensor variations. In general, the device is sensitive to alignment such that sensitivity may be adjusted from a maximum value perpendicular to the axis 133 or may be mounted angularly with respect thereto as shown in FIGS. 5 and 6. The preferred arrangement is a provision mounting the accelerometer off axis as shown in FIG. 6 but with the mounting board 132 perpendicular to axis 133 to achieve maximum response. Note that this accelerometer feature will respond not only to eccentric rotational (principal) vibration, but also to the vibrational phenomena exhibited by bearings 118 and 120.

Returning to FIG. 2, a next process stage evoked in conjunction with slipform pavers as at 12 is a dowel bar insertion (DBI) assembly represented generally at 140. The DBI apparatus 140 implants load-transfer dowels in the consolidated and preconditioned concrete directly behind the extrusion pan 86. Dowel bars are supplied to the assembly 140 by a distribution cart (not shown) and the dowels from that cart are distributed to insertion stations within a dowel bar insertion module or placement jig represented generally at 142 containing a dowel bar spacer plate. Following their placement on the insertion module 142, the dowels are positioned down within the concrete by a hydraulically powered insertion frame 144. An external vibrator 146 is mounted upon the frame 144 to facilitate this insertion sequence. In this regard, as the fork-containing insertion frame is urged into the dowels to put them in place within the concrete, the forks are vibrated to facilitate placement. In general, the DBI assembly 144 is configured such that it moves in conjunction with paver 12 movement such that there is no relative movement between it and the surface of the extruded concrete mass during the process of dowel insertion. The placement orientation, for example, of a dowel 148, is shown in phantom along with the final positioning orientation of the frame 144 as shown at 144'. As is apparent, the orientation of the dowels as at 148 and their appropriate positioning as well as the closing of the necessary openings occurring during their placement is of iortance to the integrity of the resultant roadway. Accordingly, an accelerometer as at 150 is incorporated with the vibrator as at 146 and the output thereof is conveyed as represented in dashed form by a cable 152 as directed to evaluation circuitry, for example, as associated with the monitoring housing 50.

The slipform paver 12 machine operational sequence then continues with a finishing stage or stages as represented at 154. The endless driven track associated with assembly 33 is seen in FIG. 2 at 37.

Figure 7A:
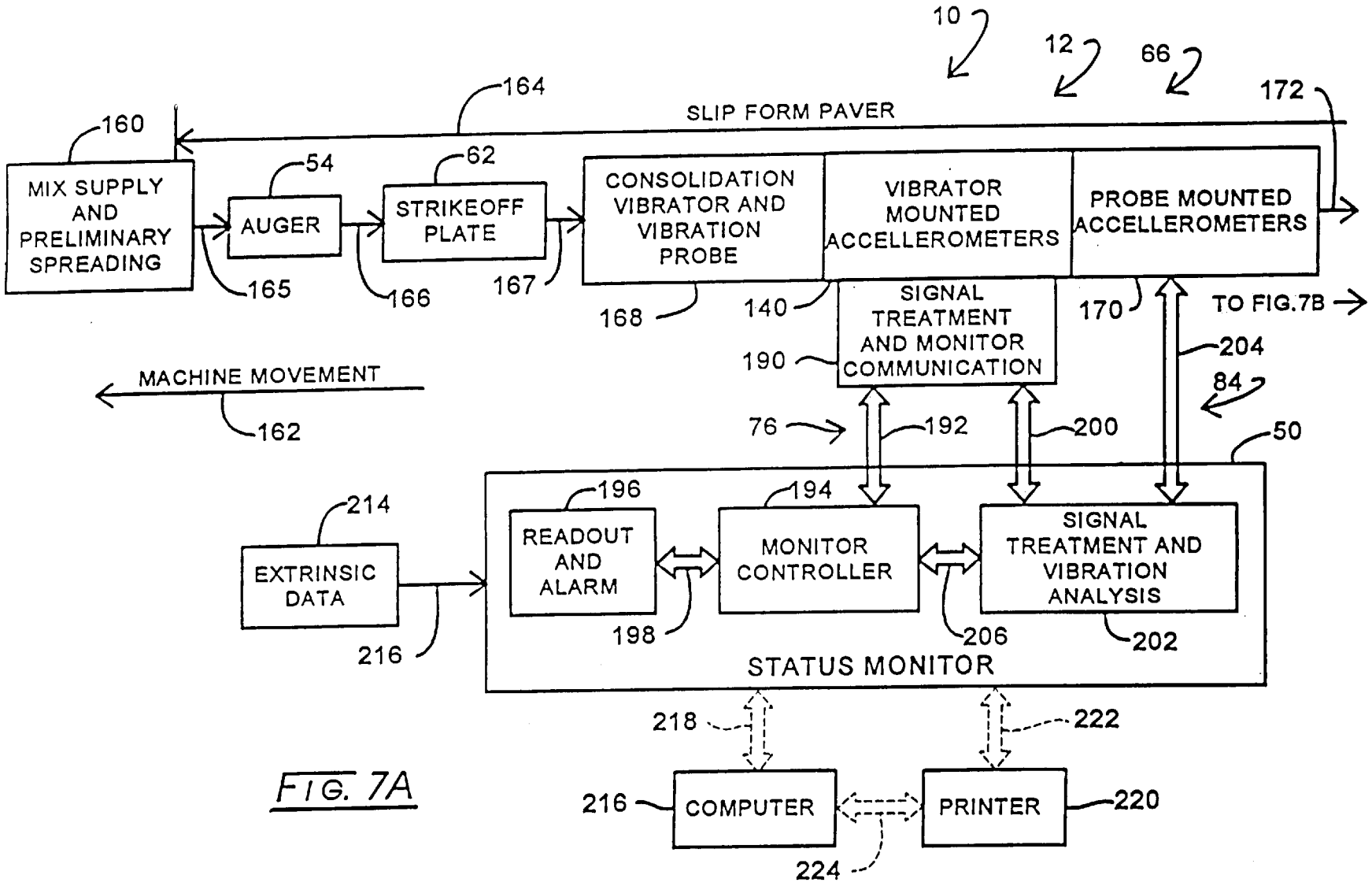
FIGS. 7A and 7B combine to form a block diagram of the system employed with the apparatus depicted in FIG. 1.
Figure 7B:
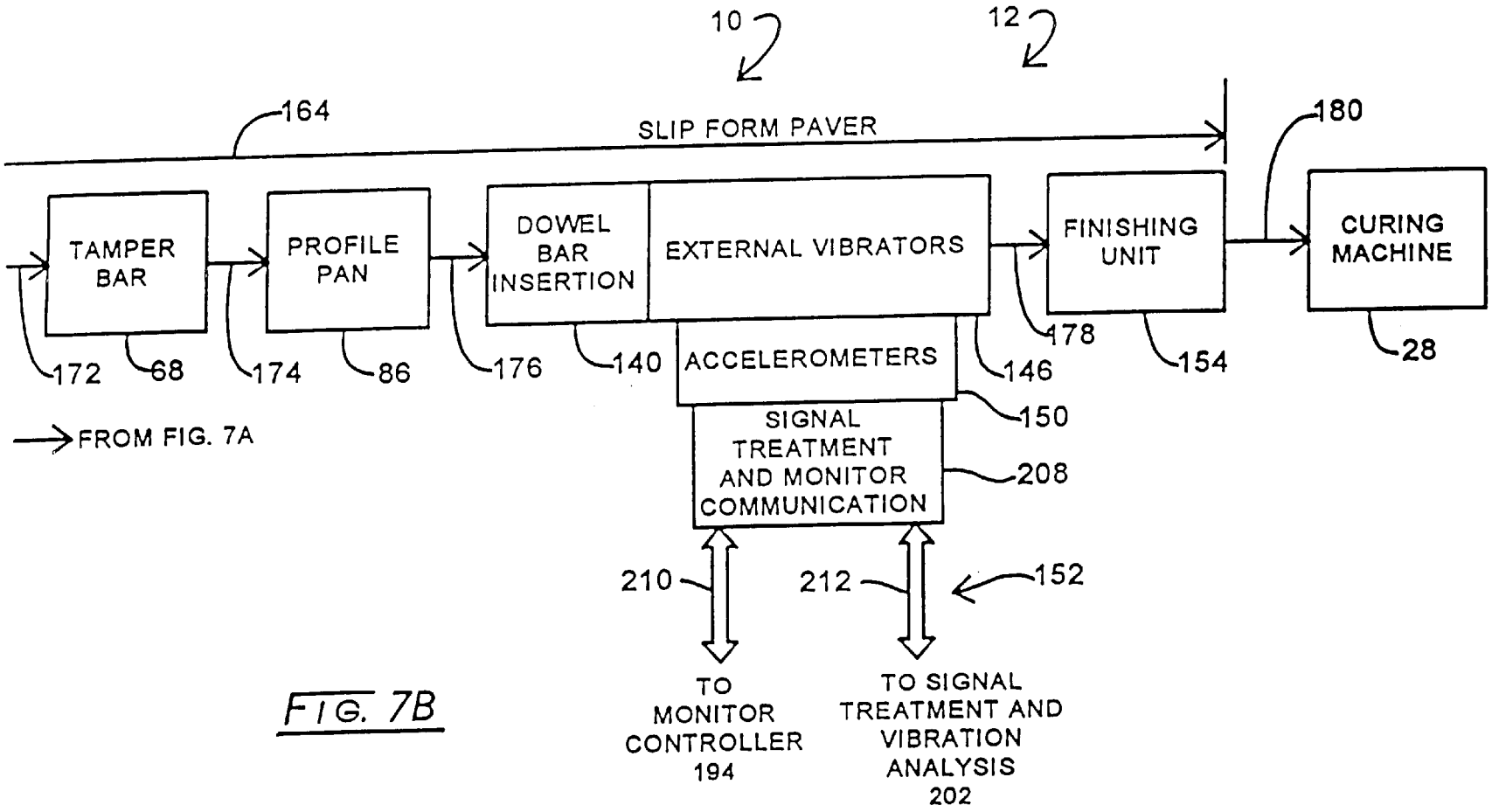

FIGS. 7A and 7B should be considered together with FIG. 7B aligned rightwardly of FIG. 7A in a viewing sense. These combined figures are a block diagrammatic representation of the slip paver 12 and curing machine 28 in association with the monitoring features of the invention. Looking to FIG. 7A, the block diagrammatically represented paving system 10 is seen to commence with the procedure wherein concrete mix is supplied and preliminary spreading is carried out as discussed in conjunction with the supply 20 of pre-mixed and deposited concrete discussed in connection with FIG. 1. Such procedure is represented at block 160. Following this preliminary deposition, the so deposited concrete mixture is encountered by the slipform paver 12 as it moves and confronts the supply, such movement being represented at arrow 162. Those functions representing at the slip-form paver function of machine 12, are represented in the figure by the horizontal extent of an arrow 164.

Following initial deposition of the concrete mix, as represented by arrow 165, the concrete mix is confronted by an auger as represented in FIGS. 1 and 2 at 54 and identified in block schematic fashion with the same numeration. Then, as represented at arrow 166, the process employs a strike-off plate earlier-described in connection with FIG. 2 at 62 and herein represented in block form with that same numeration. Following the strike-off plate, the mixture, as discussed in connection with FIG. 2, moves into the grout box region 66 and, as represented at arrow 167 and block 168, the mix is subjected to the activity of consolidation by vibrators as represented at array 72 and is mechanically probed for consolidation analysis with the probe structures 80. Coupled with each of the vibrators of the array 72 is a vibrator mounted accelerometer as described at 140 and shown in block form in the instant figure with that same numeration. Also mounted with the probe array are probe mounted accelerometers herein represented at block 170. The system then continues in its treatment procedure as represented by arrow 172 which reappears in FIG. 7B. Looking to that figure, arrow 172 is shown directed to the tamper bar function earlier-described at 68 and shown in block form with the same numeration. Following the tamper bar process function, as represented by arrow 174, an extrusion process is carried out by the moving profile pan 86 as represented in block form with the same numeration. Upon molding the plasticized concrete mix, as represented by arrow 176, a dowel bar insertion (DBI) procedure is carried out by the assembly 140 as represented in block form in the instant figure and identified by the same numeration. The dowel bar insertion components are vibrated by external vibrators, one of which is represented at 146 in FIG. 2, and is shown in block form with the same numeration in the instant figure. Accelerometers associated with such external vibrators as at 146 were described at 150 in FIG. 2 and the function thereof is represented in block form with the same numeration in the instant figure. Following the dowel bar insertion process, as represented at arrow 178, a paver mounted form of finishing is carried out as described at 154 in FIG. 2 and represented in block fashion with the same numeration in the instant figure. As noted at the arrow 164, this terminates the slipforming procedure. As discussed in connection with FIG. 1, typically, a remotely positioned curing machine as described at 28 follows the slipform paver 12 and is herein represented in block form with the same numeration in conjunction with arrow 180.

Returning to FIG. 7A, it may be observed that the accelerometers mounted with the vibrator array 72 and described, for example at 140, are coupled locally with a signal treatment and monitor communication feature which is represented in the figure at block 190. This signal treatment function incorporates, inter alia, a local signal treatment or vibration conversion network which responds to acceleration signals from the accelerometers 140 to provide conversion outputs corresponding with period of vibration which are transmitted via the earlier-described harness and as represented herein by communications arrow 192 to the controller function 194 of the monitor function, for example as described at 50 in FIG. 1. That monitor 50 is represented in the instant figure by a block-shaped boundary carrying the same identifying numeration. The monitor assembly and monitor controller are, for example, mounted upon the frame 30 of the slip paver machine 12 at console 46 and respond to applied conversion outputs for deriving rate output signals corresponding with the rate of vibration of each vibrator of the array 72. In this aspect, the monitor controller functions to provide outputs to a readout and alarm function represented at block 196 via interaction represented at dual communications arrow 198. Both high and low alarm values of vibration rate (VPM or RPM) are manually inserted in the monitor system. Alarm conditions are displayed both as a readout and aurally. Such alarm conditions are subject to validation during start-up and shut-down procedure. The monitor communications feature as represented at block 190 also functions, as represented by communications arrow 200, to provide accelerometer generated signals to a signal treatment and vibration analysis circuit represented at block 202. Note additionally, that the same type signals are conveyed from the probe mounted accelerometer as represented at block 170 to the same signal treatment and vibration analysis circuit 202 as represented by the communications arrow 204. Conveyance functions represented at arrows 192, 200, and 204 are incorporated, for example in earlier-described cable harness 76 and cable 84 as represented in the drawing. The circuit represented at block 202 carries out user designated treatment of the incoming accelerometer-based signals with appropriate filtering and integration stages, as well as any necessary multiplexing and analog-to-digital conversion, and provides the resultant vibration data to the monitor controller function for further treatment, i.e. memory retention, for distribution as represented by the communications arrow 206.

Looking again to FIG. 7B, it may be observed that the accelerometer associated with the external vibrators 146 of the DBI assembly also provide acceleration signals to a signal treatment and monitor communication circuit or network as represented at block 208. The function carried out at block 208 may be substantially identical to that carried out at block 190 and the circuits may be provided locally in communication with each accelerometer. Then, as represented at dual communications arrow 210, and earlier-described at cable 152, the data so derived may be transmitted to monitor controller 194 (FIG. 7A). Additionally, as represented by communications arrow 212, the accelerometer derived signals may be transmitted for signal treatment and vibration analysis as discussed in connection with block 202 in conjunction with FIG. 7A.

Returning to FIG. 7A, extrinsic data is shown being submitted to the monitor function 194 as represented at block 214 and arrow 216. Such data will include calendar and time of day data, the time of power-up of the paver machine 12 to provide notation of the commencement of the process carried out by it, ambient temperature, and ambient humidity as well as any other data as may be appropriate. Such data as well as the status of the process at a given period of performance may be retained in memory in conjunction with the monitor controller 194 or subsidiary components for subsequent readout, for example, at the end of a given period of operation, by a computer function as represented at block 216 and communications arrow 218. The computer function 216 may be provided, for example, as a conventional lap-type device. A status monitoring function may provide permanent readouts, for example, to a printer as represented at block 220, and dashed communications arrow 222. Additionally, this printer function may be associated with the computer function represented at block 216 as represented by the dashed communications arrow 224.

Figure 8:
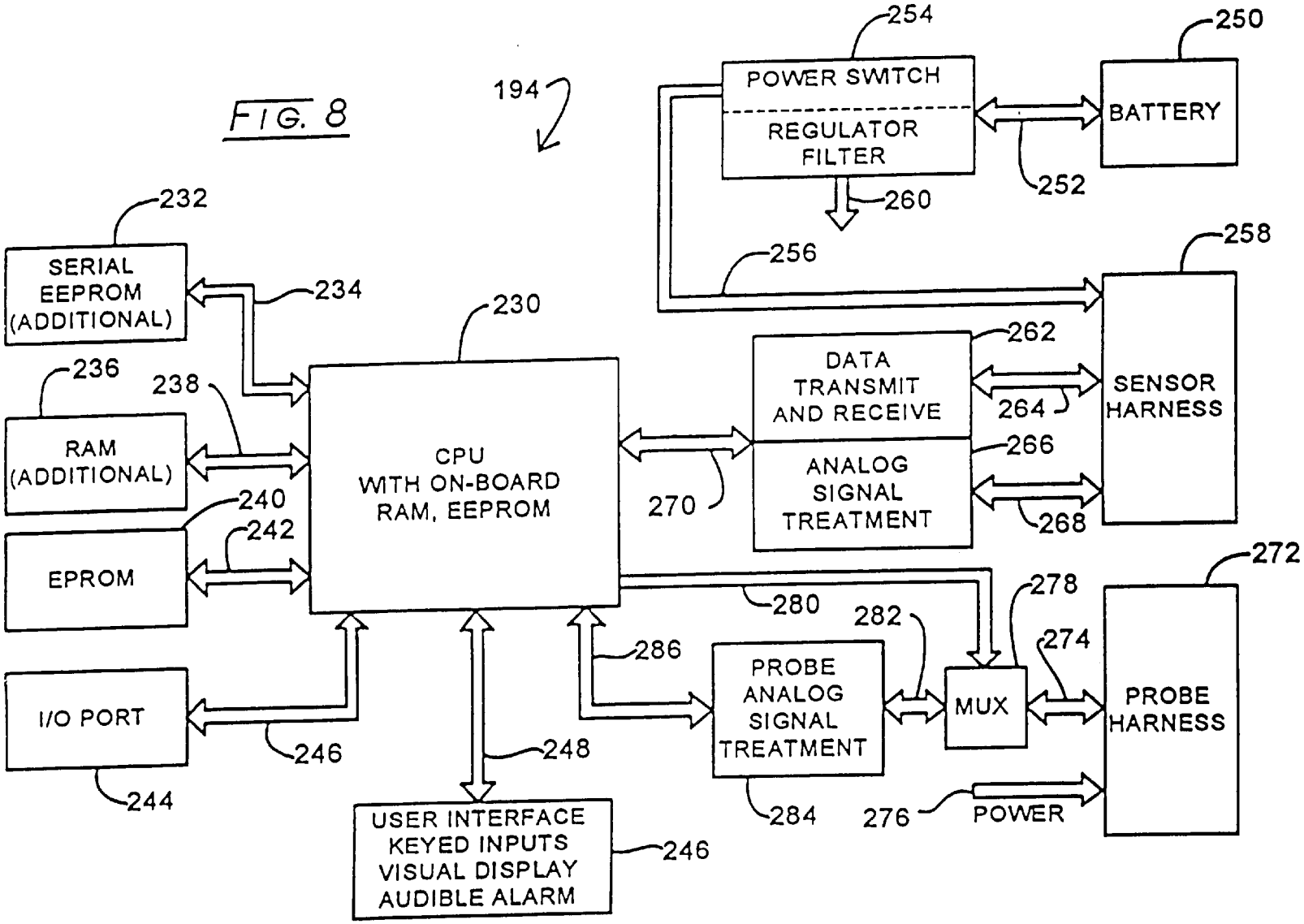
FIG. 8 is a block diagram of a monitor system according to the invention employed with the apparatus of FIG. 1.

Referring to FIG. 8, a block diagrammatic representation of the monitor controller function is described, inter alia, in conjunction with block 194, and such functions as described in conjunction with FIGS. 7A and 7B. The monitoring function performs in conjunction with a microprocessor and associated components as represented at block 230. The microprocessor may, for example, be provided as a type MC68HC11AIFN marketed by Motorola, Inc. The device 230 operates in conjunction with supplementary memory having a non-volatile characteristic which can be written to by the computer function 230 and is represented as available EEPROM as represented at block 232. The interactive communication between this memory at 232 and CPU 230 is represented by bus 234. Additional random access memory (RAM) also is made available to the computer function 230 as represented at block 236 and bus 238. Supplementary read only memory (ROM) is shown represented at block 240 in conjunction with a bus represented at arrow 242 and the input/output feature associated with the CPU 230 is represented as 110 ports at block 244 performing in conjunction with an appropriate bus-type communications function as represented at arrow 246. The device 230 also performs in conjunction with user interface components such as a keyboard, a visual display, audible alarm, functions such as those described in FIG. 7A in conjunction with blocks 214, 216, and 220 and the like, as represented at block 246 and a communication coupling as represented at arrow 248.

Power is supplied to the monitoring function by the battery or power source available from the slipform paver 12 itself and is represented in the figure at block 250. This battery power source is tapped and monitored as represented at arrow 252 by a power switch, regulator function, and filter function as represented at block 254. The function represented at block 254 provides power to certain of the sensing components of the system at hand as represented by the arrow 256 directed to the sensor harness represented at block 258. Additionally, as represented by the arrow 260, regulated power for circuit utilization is provided to all requisite circuitry within the system. The latter sensor harness described, inter alia, in conjunction with the harness component 76 in FIG. 2 provides the earlier-noted conversion outputs from communications function 190 to a data transmit and receive function represented at block 262 and arrow 264. Similarly, data from the accelerometers is provided to an analog signal treatment function represented at block 266 and arrow 268. The data convened at blocks 262 and 266 is directed to the CPU function at block 230 as represented at arrow 270.

Acceleration signals as are derived from the probe mounted accelerometers as discussed at block 170 in FIG. 7A are submitted for signal treatment via a probe harness as represented at block 272 and arrow 274. Power is supplied from the power function 254 to these accelerometers as represented by the arrow 276. To address each of the accelerometers of the array of probes 80, a multiplexing function under the control of the processing function 230 is provided as represented at block 278 and arrow 280. Interrogated accelerometers of the probe components provide acceleration signals as represented at arrow 282 to a probe analog signal treatment function represented at block 284. The resultant vibration related data then is submitted for retention or treatment to the processing or controller function 230 as represented at arrow 286. The signal treatment provided in conjunction with block 284 may be the same as that provided by th signal treatment provided in conjunction with block 266 and will include such functions as filtering, user selected integration, and digitization. In this regard, an initial integration of the acceleration signal will provide a vibration velocity signal and a dual integration will provide velocity displacement data. Where vibration displacement or velocity transducers are used, the use of such integration procedures is eliminated or reduced accordingly. These integration functions can be carried out in software at later stages of the process. The analog signal treatment evolved in conjunction with the function at block 266 additionally may provide data representing the operational condition of bearings as discussed at 118 and 120 in connection with FIG. 5. Such data may provide prediction as to potential bearing failure for timely correction before breakdown with attendant production loss. In general, the bearing analysis is involved with the development of a data signal referred to in the industry as "spike energy". The above features are described by Davis and Hays in U.S. Pat. No. 4,612,620, entitled "Apparatus for Collecting Scheduled Maintenance Data", issued Sep. 16, 1986, and incorporated herein by reference Referring to FIG. 9, an operator facing view of the monitor 50 for carrying out one monitoring function of the system of the invention is revealed. The housing 288 of the monitor is seen to incorporate a mounting bracket 290 with tightening knobs 291 and 292, and is coupled with cabling, for example, the data inputs described at 152 and 84 in conjunction with FIG. 2 and a power input 252. A liquid crystal display (LCD) 294 is provided at the face of the device. A switch 296 provides for selection of either a scanning readout or individual manual readout of accelerometer data. Keyed inputs to the monitor are provided as an on/off power switch 298, a mode switch 299, menu addressing up and down switches 300 and 301, and an operator acknowledge switch 302. Input/output terminals and associated components for interfacing with external printers, computers, and the like are not revealed in the figure.

Figure 9:
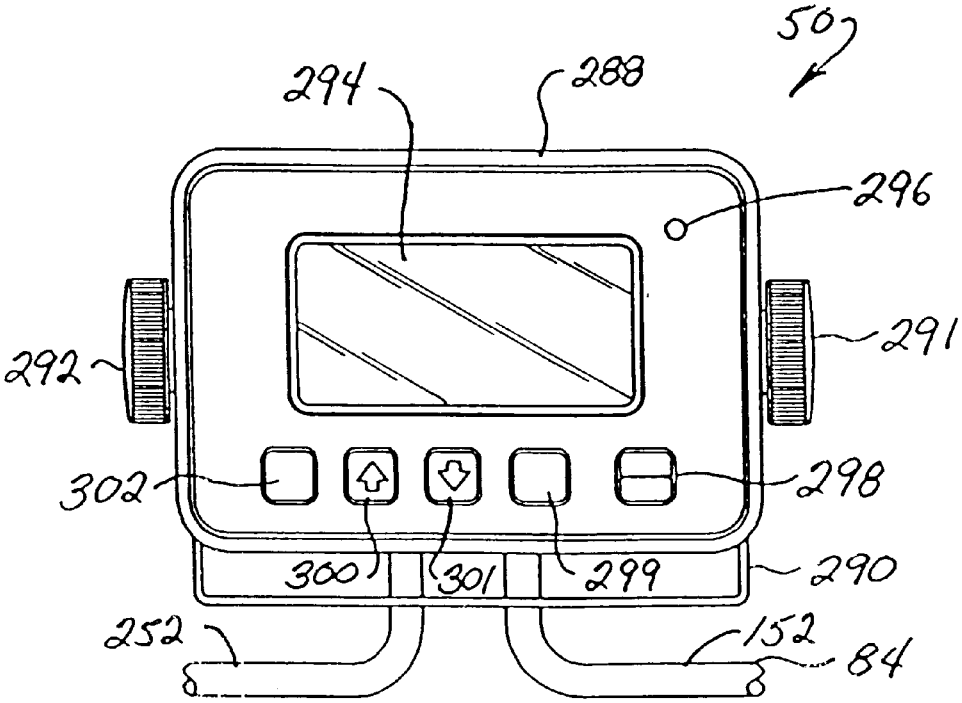
FIG. 9 is a front view of a monitoring readout and housing assembly employed with the invention.

The basic readouts developed from the monitor controller function described in conjunction with FIG. 8 and the readout represented at FIG. 9 provide for the presentation of vibration frequency data evolved from the vibrator array 72 to the operator either with respect to a scanning approach to each of the vibrator components in array 72 or by operator selection of a given vibrator component. This particular vibration frequency collection function is provided utilizing essentially a three wire communication to all vibrators in conjunction with a polling or interrogation software technique. Inasmuch as each of the accelerometers of the vibrator array are manufactured with an electronically accessible serial number, a leaming mode is provided wherein the user is prompted to insert an appropriate cable from a given vibrator mounted accelerometer into the control system for purposes of recording its serial number in memory. In commencing an operation, the monitoring system will enter a wake-up mode wherein each of the vibrator mounted accelerometers are interrogated or polled and assigned a number for the sequence utilized in scanning acceleration data and for individual interrogation. For example, 16 accelerometers may be associated with the respective 16 vibrators and given logical addresses or polling addresses numbering in correspondence from 1 to 16. Upon being polled, the accelerometer associated circuitry as described at block 190 in FIG. 7A will provide the period of the acceleration (time betweek peaks) to the monitoring function. This readily is converted to vibrations per minute (VPM) or, in effect, eccentric revolutions per minute (RPM). Of course, the acceleration signal carries data above and beyond that associated with the rotational rate of eccentric 116 (FIG. 5).

Figure 10:
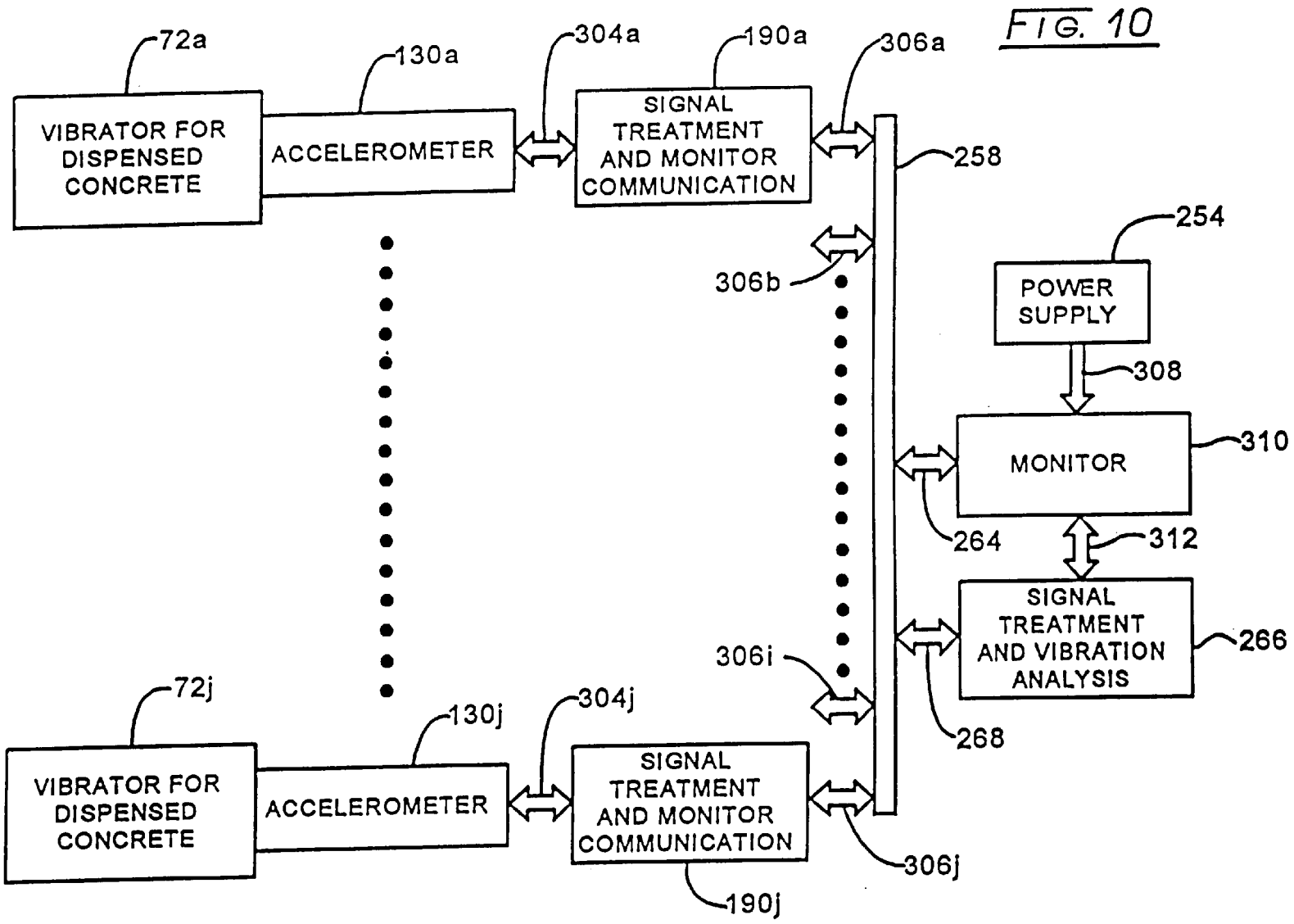
FIG. 10 is a block schematic diagram showing the application of accelerometer monitoring components associated with vibrators employed with the system of the invention.

Referring to FIG. 10, a block diagrammatic representation is made of the functioning of the monitoring system with respect to the array of vibrators 72. In the figure, these vibrators are represented in spaced relationship with respect to the harness 258 as at 72*a* with vertical dotted indications representing a progression of vibrations from first to last ending with vibrator 72*j* in consonance with the description in FIG. 2. An accelerometer is associated with each such vibrator, the accelerometer being earlier-identified at 130 and as associated with a given vibrator in the instant demonstration, being alphabetically designated in conjunction with that vibrator designation. The accelerometer-based acceleration signals are presented along with interactive communication to the earlier described signal treatment and monitor communication local circuits 190. Those circuits are represented as at 190*a*–190*j* for the purpose of showing that each is associated with a given accelerometer. Interactive communication between such networks and the accelerometer associated therewith is represented by interactive arrows as at 304*a* and 304*j*. Communication to circuits 190*a*–190*j* from harness 258 is with three wires, one carrying data, one carrying power, and the other providing ground. That communication is represented at the dual arrows 306 as associated with the alphabetic designations corresponding with the vibrator component alphanumeric designations. Power supply 254 again is represented in block form in the figure along with a distribution arrow 308 seen to provide, for example, five volt and 12 volt inputs for appropriate distribution by the monitor function as represented at 310. Correspondingly, signal treatment and vibration analysis for predictive maintenance purposes and the like is represented again at block 266 in conjunction with communication arrow 268. The functions at block 266 with the monitor function 310 is represented at communications arrow 312.

Figure 11:
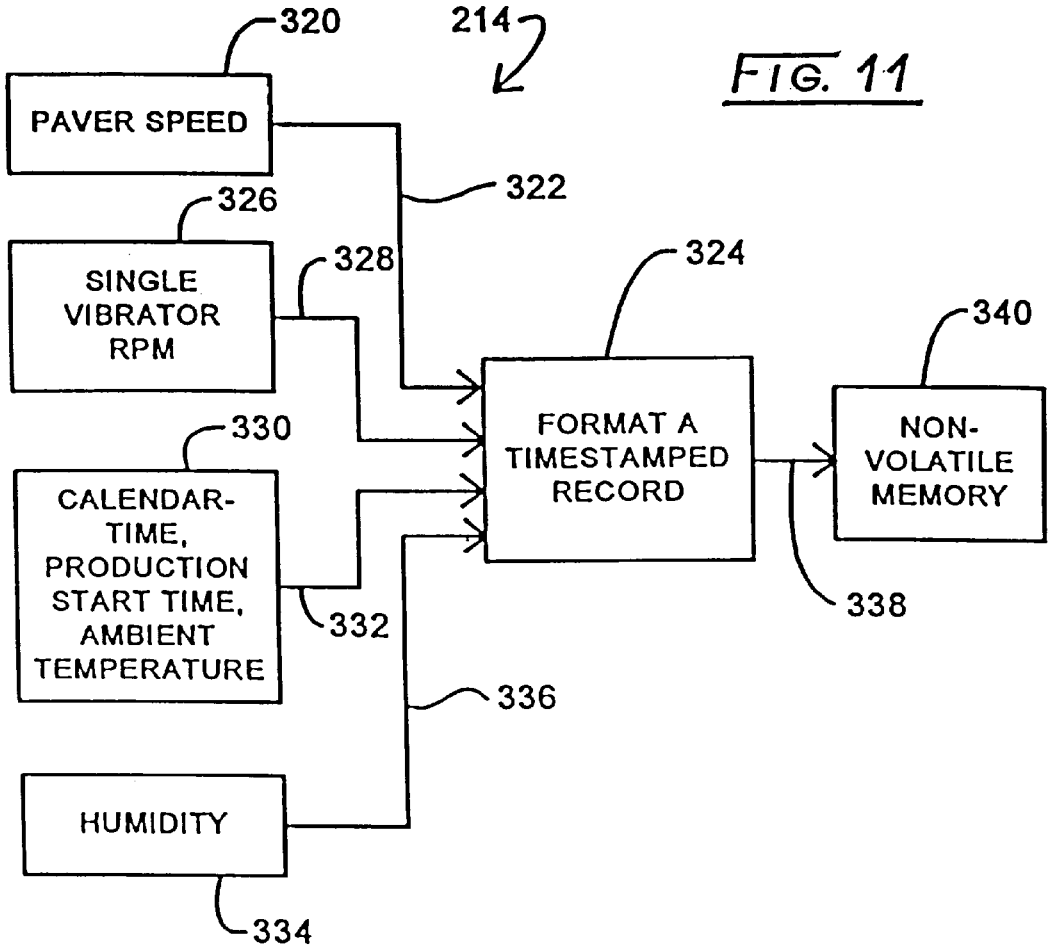
FIG. 11 is a block diagram of a data log function of the monitoring system of the invention.

Referring to FIG. 11, the functioning of the status monitor with respect to the extrinsic data described in conjunction with FIG. 7A and block 214 is revealed at an enhanced level of detail. The extrinsic data which may be provided, will include paver speed as represented at block 320 which is seen as represented at line 322 being directed to a function wherein the data is formatted in conjunction with a time stamped record. The latter function is represented by block 324. Additionally, for each vibrator of the array 72, the frequency of vibration, for example, as developed in revolutions per minute or vibrations per minute may be inserted to the function 324 as represented at block 326 and line 328. Next, calendar and time data, production start time, and ambient temperature may be inserted to the function 324 as represented at block 330 and line 332. Finally, humidity data may be supplied to the time stamped record function 324 as represented at block 334 and line 336. Data so compiled then may be stored in non-volatile memory as represented at line 338 and block 340. Such data may be printed as represented by the printer function block 220 or downloaded to the computer function 216 as discussed in conjunction with FIG. 7A.

Figure 12:
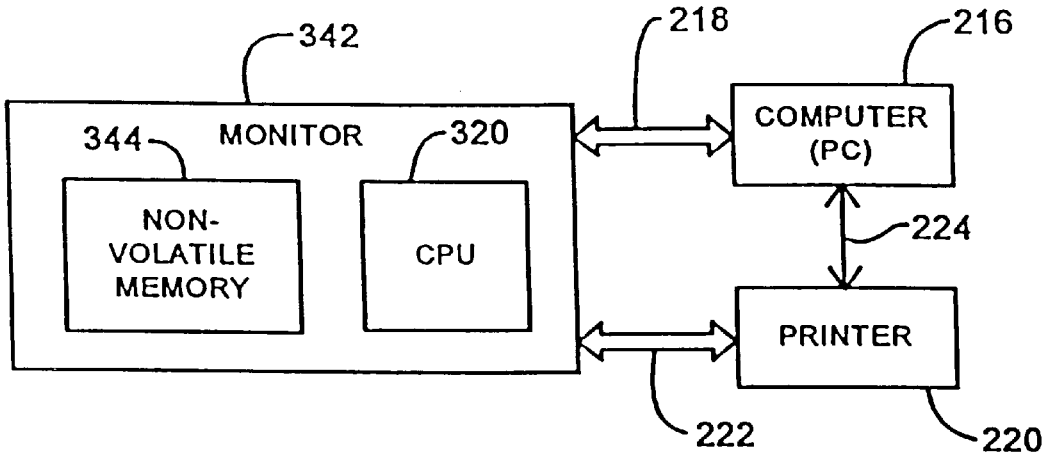
FIG. 12 is a block diagram of a monitor employed with the system of the invention in conjunction with external devices such as a computer and printer.

Looking to FIG. 12, the downloading feature is described. In the figure, the monitoring function is represented at block 342 as containing the microprocessor (CPU) 230 and non-volatile memory represented at 344. These components of the monitoring system communicate with a computer such as a laptop as represented by block 216 and communications arrow 218. Additionally, the monitor function 342 may communicate with a printer as represented at block 220 via communication arrow 222. As an alternative, the printer and computer function 216 may communicate as represented at dual arrow 224. The computer and printer components will be recognized as carrying the same numeration as provided in conjunction with FIG. 7A above.

Figure 13:
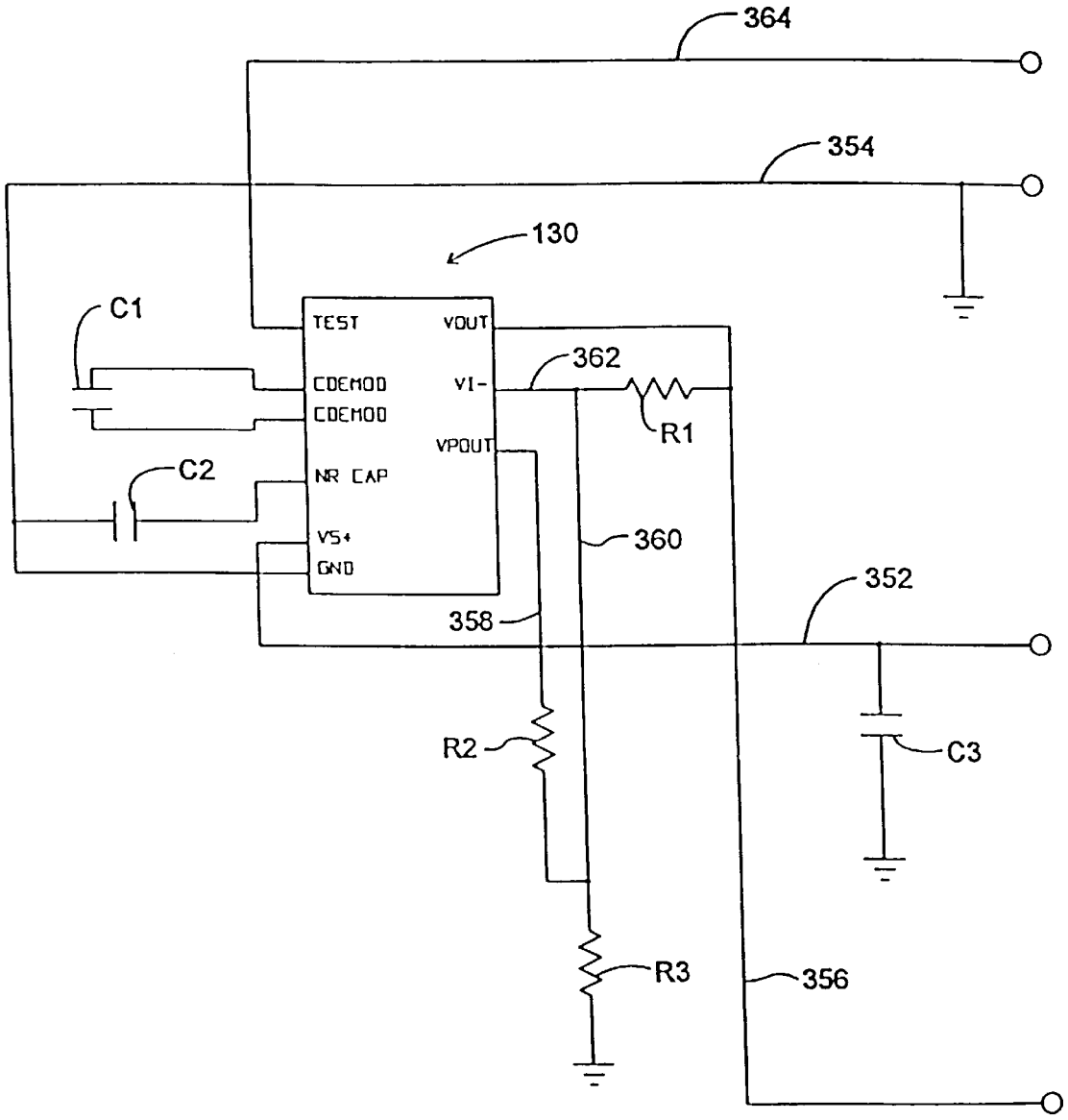
FIG. 13 is an electrical schematic diagram of an accelerometer circuit employed with the invention.

Referring to FIG. 13, an accelerometer assembly as described at 130 above is illustrated at an enhanced level of detail. The assembly 130 principal device will exhibit a most sensitive axis which generally will be defined by the manufacturer in connection with its package arrangement. The device is configured with a demodulator capacitor C1, a noise inhibiting capacitor C2, and a capacitor C3 coupled between ground and +5 v supplies power to device 130 via line 352. Ground for the assembly is provided at line 354, while the output line carrying an acceleration signal is provided at line 356 coupled to the VOUT out terminal of device 130. A configuration of resistors R1–R3 are connected with the VI and VPR terminals to provide a sensitivity representing the output voltage change per g unit of acceleration applied. In particular, this sensitivity is specified at the PR terminal seen coupled with line 358 which, in turn, is coupled with lines 360 and 362. A self-test input is provided at line 364. In general, the analog output voltage at line 356 is directly proportional to acceleration.

Figure 14:
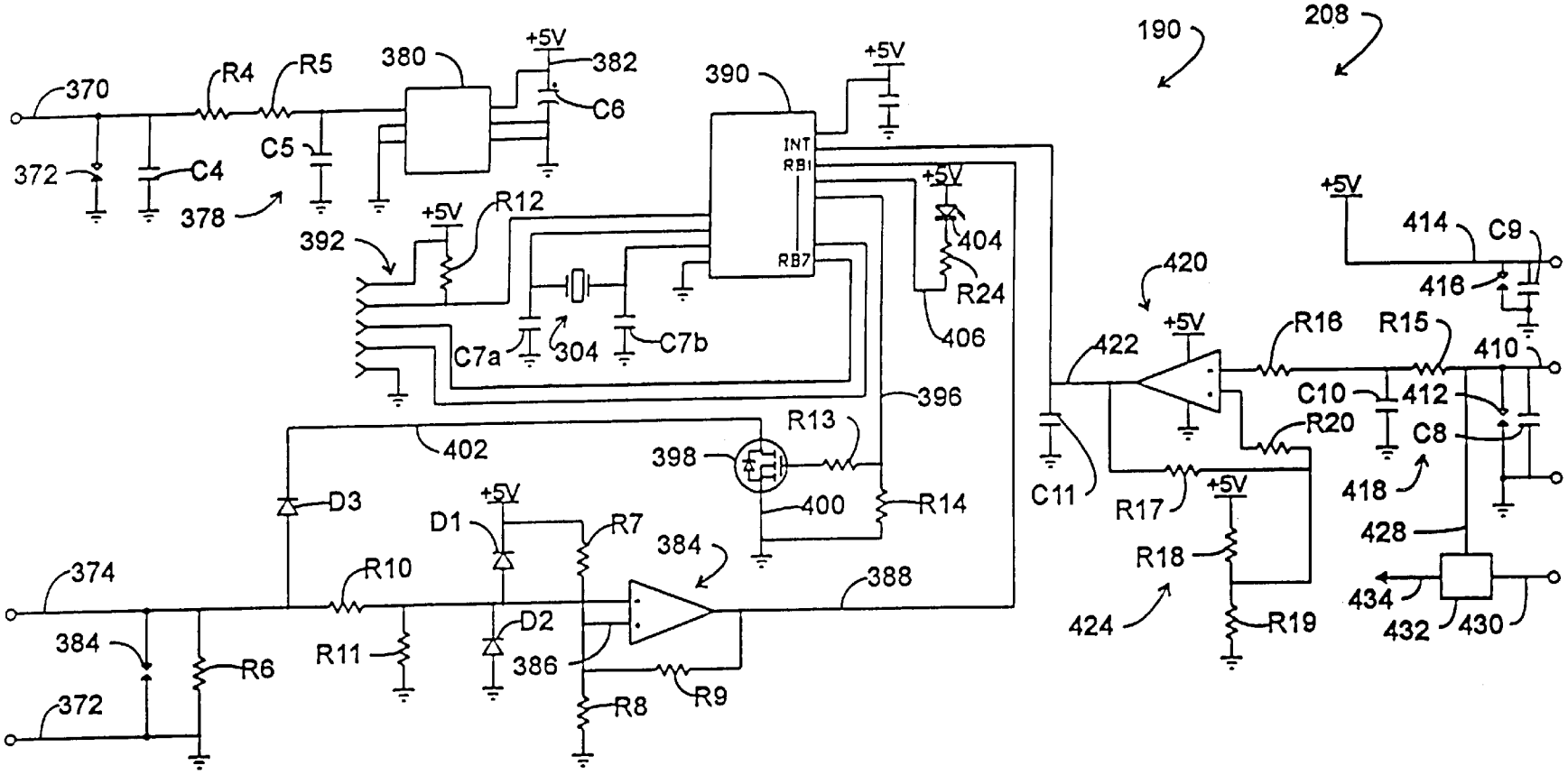
FIG. 14 is an electrical schematic drawing of a signal treatment and monitor communication circuit employed with the system of the invention.

Referring to FIG. 14, a schematic representation of the signal treatment and monitor communication network described, for example, in conjunction with blocks 190 and 208 (FIGS. 7A, 7B) is presented. The circuit of FIG. 14 is an implementation of either the signal treatment and monitored communication represented in FIG. 7A at block 190 or the equivalent circuit shown in FIG. 7B at block 208. In general, an array of such circuits are incorporated, a local one being associated with each of the accelerometers mounted upon or otherwise vibrationally coupled with a vibration generating device. The circuits function in conjunction with a software form of multiplexing carried out by the monitor function which, as discussed generally above, involves the utilization of a polling technique. In addition to providing polling response, the local circuits develop vibration frequency information in terms of the period of vibration which may be converted to a time rate parameter of vibration. Additionally, the circuits selectively will pass analog acceleration data from the accelerometer. The latter data permits mechanical vibration analysis for preventive maintenance and related predictive procedures.

The monitor communication side of the circuit of FIG. 14 involves only three wires which are represented in the figure as a power input line 370, a ground line 372, and a data line 374. The latter, data line functions in a duplex manner providing both transmission and reception of data. Line 370, carrying +12 v power supply from the monitor power function 254 initially is protected by a board mounted spark gap 373 coupled between the power input and ground as well as a filter network represented generally at 378 comprised of capacitors C4 and C5 as well as resistors R4 and R5. Line 370 is directed to the input terminal of a regulator 380 which is protected by a relatively large capacitor C6 and provides a +5 v instrumentation output at line 382 for distribution to the adjacent circuit components. Capacitor C6 is employed inasmuch as the application at hand is one similar to that of the automobile field where transient phenomena can temporarily terminate power. Accordingly, capacitor C6 maintains a circuit operative during any such transients. Additionally, such systems call for protection by spark gap as described at 373 and which will be seen within the circuitry at hand. Line 372 is seen coupled to ground and data line 374 may be observed to be protected by a spark gap 384 and is coupled via resitor R6 to ground. Data input to bidirectional data line 374 initially is directed to one input of a comparator stage 384. Implemented as a type LM2904G device, the reference input to the stage 384 being provided at line 386. The reference voltage at line 386 is established by a resistor network including resitors R7, R8, and R9 which are selected to provide hysteresis for the operation of the stage 384, which stage functions to provide a serial pulse output with a range or swing of 0 to 5 volts at its output line 388. This output corresponds with monitor polling data and the like for the 12 volts at line 374. Protection against voltage excursions at line 374 is provided by clamping diodes D1 and D2, while resistors R10 and R11 function as a divider reducing the maximum voltage at line 374. Line 388 extends to the RB1 port of a microprocessor 390. Device 390 may be provided, for example, as a type TIC16C620-04/LSC marketed by Microchip, Inc. The device 390 may be programmed from a network 392 incorporating a resistor R12 and receives an oscillatory input for clocking purposes at appropriately designated terminals from an oscillator network represented generally at 304 which includes capacitors C7*a* and C6*b*.

Data output from microprocessor 390 is provided at line 396 which extends through a gate resistor R13 to the gate of a field effect transistor 398. Additionally, line 396 extends through gate-to-source resistor R14 to ground at line 400. With the arrangement shown, serial data may be supplied from the microprocessor 390 as a negative going true pulse at line 402 which is seen to extend through a protective diode D3 to line 374.

Looking to the accelerometer inputs to the circuit, raw acceleration data from the accelerometer is provided at input line 410 which is coupled to accelerometer output line 352 (FIG. 13) and, is protected by a spark gap 412 and capacitor C8 coupled to ground. Power input to the accelerometer as discussed at line 352 in FIG. 13 is provided from line 414 coupled, in turn, with common +5 v from line 382. Line 414 additionally is protected by a spark gap 416 and capacitor C9. Line 410 incorporates a filter network 418 including resistor R15 and capacitor C10 and extends through resistor R16 to one input of a comparator stage 420 including a type LM2904D comparator and having an output at line 422. Stage 420 is configured with a hysteresis developing resistor network 424 which provides a voltage reference level at the second comparator input which is comprised of resistors R17-R19 and further includes a current balancing resistor R20. Output line 422 is protected by a capacitor C11 and functions to provide a squarewave at the input terminal of microprocessor 390 corresponding with the period of acceleration peaks and, by simple conversion, vibration frequency of an associated vibrator.

A red light emitting diode (LED) 404 is shown coupled through a resistor R24 and line 406 to the processor 390. This LED is provided for diagnostic purposes, for example, being energized each 16 bits of the clock or operational cycle of device 390.

Raw acceleration data further is provided from line 410 via lines 428 and 430, the latter line being enabled from a solid-state switch 432 under the control of microprocessor 390 as represented at line 434.

Figure 15A:
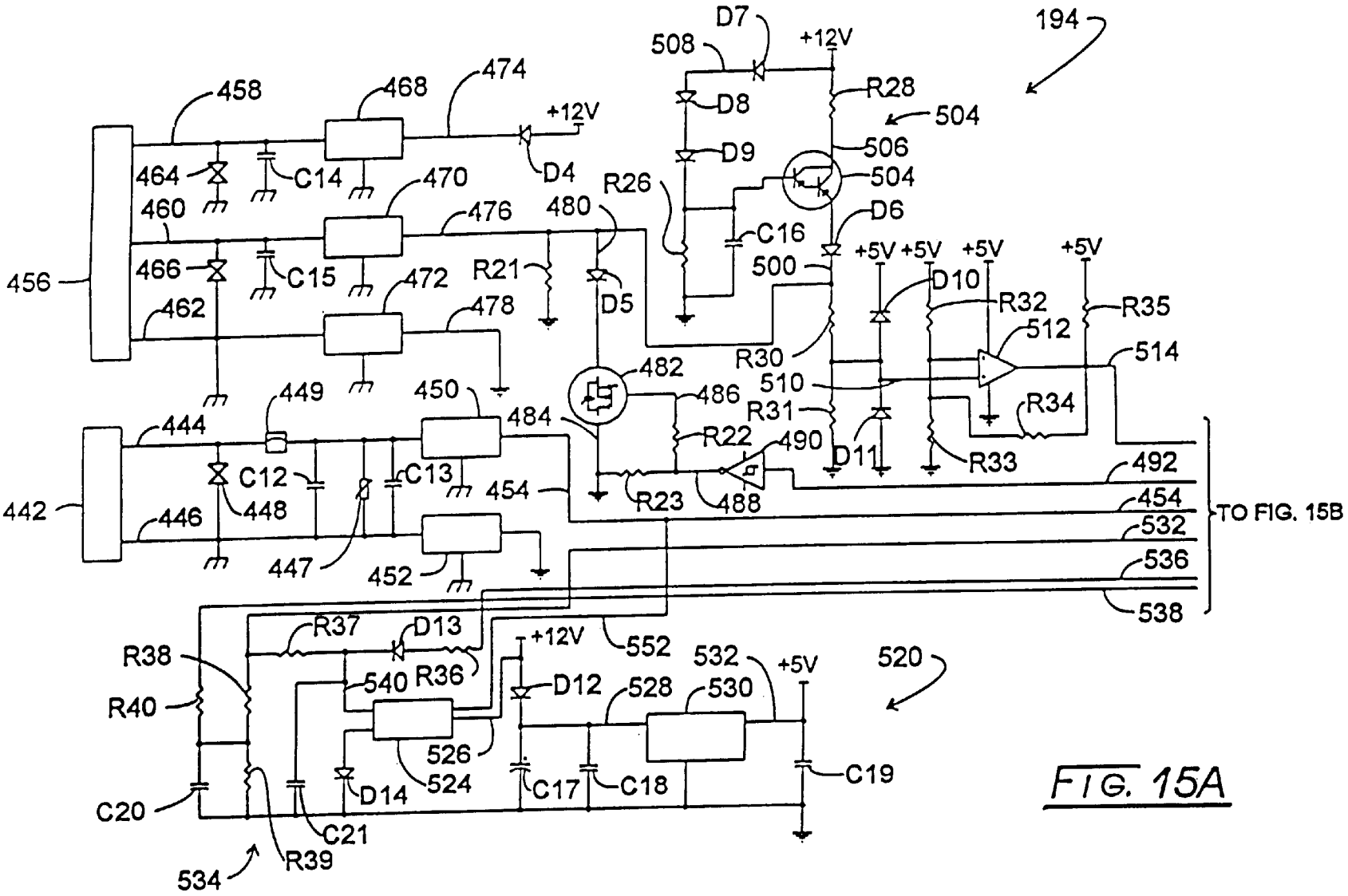
FIGS. 15A–15C combine as labeled thereon to provide an electrical schematic diagram of a monitor embodiment of the system of the invention.
Figure 15B:
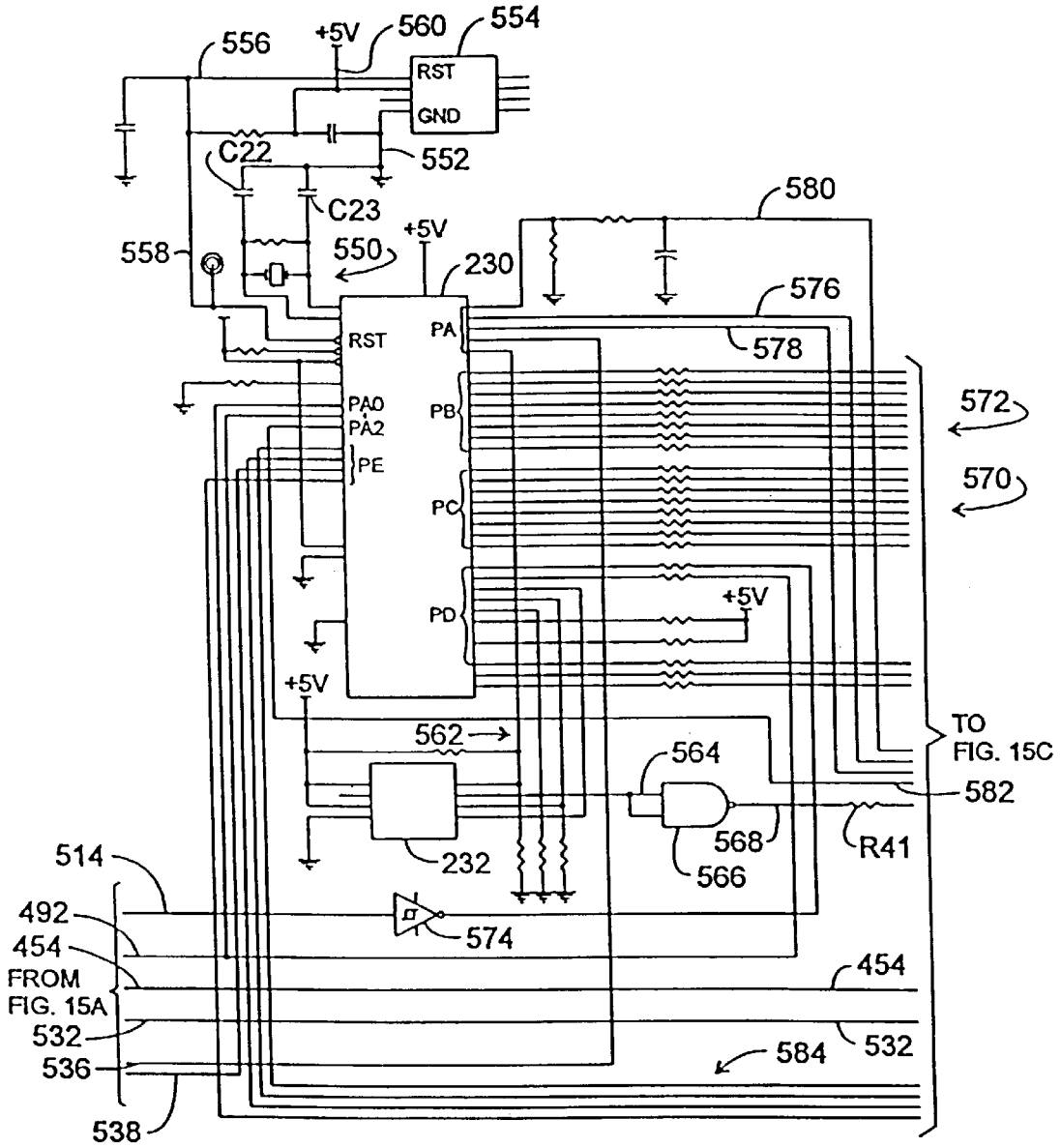
Figure 15C:
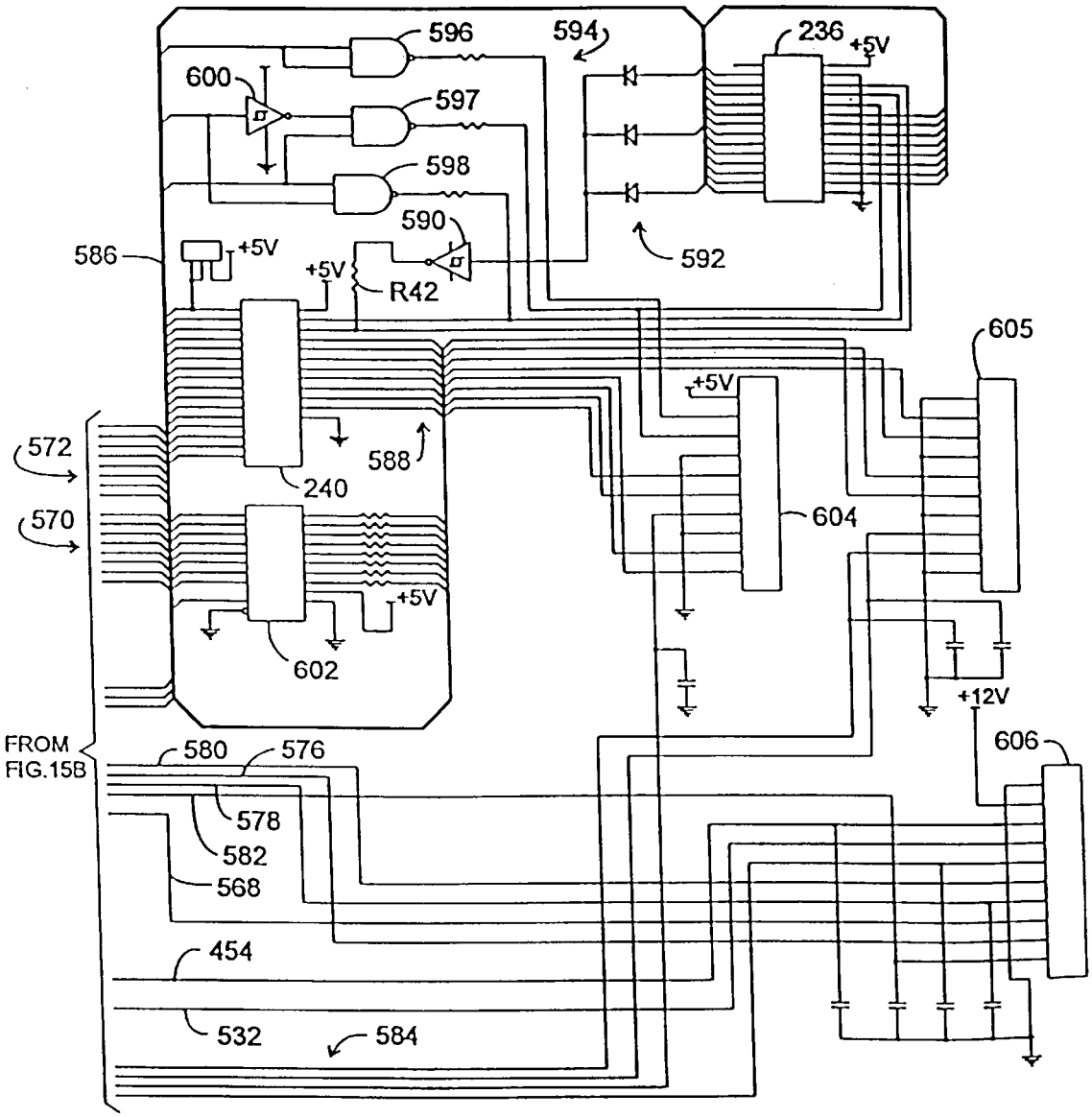

FIGS. 15A–15C combine as labeled thereon to illustrate an electrical schematic diagram of the principal components of function the monitor 194. Prime mover or power source 42 battery power, for example at 12 v, is supplied to the monitor 194 via an input connector represented at block 442. Accordingly, +12 v and machine ground are provided, respectively, at lines 444 and 446. The circuitry is protected from excursions from this source by a spark gap 448 as well as a self-resetting fuse-like resistive device 449. Devices as at 449 may, for example, be provided as type RXE375. Additional protection is provided by capacitors C12 and C13 as well as a MOV device 447. The input at lines 444 and 446 additionally are protected by EMI filters shown, respectively, at 450 and 452. Output from device 450 at line 454 represents the 12 v "supply" of the monitor circuit.

The function of "multiplexing" carried out in conjunction with circuits 190 and 208 is, as discussed above, a software implementation using three wires, except with respect to the vibration analysis of the accelerometer signal for the purposes of preventative maintenance and vibrator performance evaluation with respect to mixed monitored effects and the like. These three wires may be configured with a harness arrangement as described in conjunction with FIGS. 8 and 9. Connection for such harness with the monitored circuit 194 is provided at connector as at 456, the circuit input side of which is shown as a power supply line at 458, a data line 460, and a ground line 462. As before, these lines are protected by spark gaps as shown at 464 and 466 as well as static protecting capacitors C14 and C15. Lines 458, 460, and 462 additionally extend through EMI protection circuits shown, respectively, at 468, 470, and 472, which are seen to be coupled, respectively, with lines 474, 476, and 478. Line 474 is seen to be coupled to +12 v through a protective diode D4 and line 478 is coupled to ground. Data line 476 is seen coupled to pull-down resistor R21 and extends, inter alia, to line 480 and steering diode D5 to the source electrode of an FET 482. The drain electrode of device 482 is coupled via line 484 to ground, and the gate thereof is connected through line 486 and resistor R22 to line 488. A gate-to-drain resistor R23 is coupled within line 488 to ground and line 484. With the arrangement shown, serial data which is logic low true may be asserted by appropriate gating of device 482 to draw line 476 to ground and thus assert data to line 460 and connector 456. The pulse input at line 488 is treated by a Schmitt inverter 490, input to which is seen at 492.

Vibration period data transmitted from circuits as at 190 and 208, for example, from line 374 (FIG. 14) is transmitted along earlier-described line 476 to line 500. Line 500 is coupled with a current source form of pull-up network represented at 502 which is configured with a Darlington PNP device 504, the collector structure of which is coupled in conjunction with diode D6 to line 500 and the emitter structure of which is coupled through line 506 and resistor R16, R28 to +12 v. A line 508 incorporating diodes D7–D9 provide for current limitation in conjunction with resistor R28 and are seen connected with the gate of device 504. A filter comprised of resistor R29 and capacitor C16 additionally is seen coupled with the current limiting network at line 508. Line 500 additionally extends to a divider network comprised of resistors R30 and R3 1, the junction between which is coupled to paired protective or clamping diodes D10 and D11 and line 510 to one input of an operational amplifier. The positive-going input of device 512 is coupled to a hysteresis and reference defining network comprised of resistors R32–R34, the latter being coupled to output line 514 which, in turn, is coupled to +5 v through pull-up resistor R35.

A power network for a monitor circuit 194 is represented in general at 520. The treated 12 v supply at line 454 is tapped at line 522 to provide +12 v at a solid-state power switch 524. Provided, for example, as a type VN20N, the switch 524, upon being actuated, permits the assertion of +12 v through a diode D12 through line 528 to the input of a voltage regulator 530. The output of device 530 at line 532 provides +5 v for powering the circuitry of the system. This regulator function is filtered by capacitor array C17–C19.

Actuation of the switch 524 is derived from the manual actuation of the momentary pushbutton switch or power key 298 on the monitor display (FIG. 9). This provides for a momentary assertion of the battery supply voltage from line 454 through that switch (FIG. 16A) and thence back through line 532, resistor R36, diode D13, and resistor R37 to a divider network comprised of resistors R38 and R39, and shown generally at 534. This action also provides for holding line 540 and one input to switch 524 at a high logic level. Network 534 provides about a 6 v signal which is applied through resistor R40 and line 538 to the microprocessor function of the circuit (FIG. 15B). Capacitor C20 provides appropriate filtering. While a signal will have been asserted to the microprocessor function, it is not "awakened" at this juncture. In this regard, as noted, the signal at line 536 from the manually actuated switch also is asserted via line 540 as filtered at capacitor C21 to the input of switch 524. The ground terminal of that switch is coupled via diode D14 to ground. Accordingly, switch 524 is actuated to create circuit enabling +5 v at line 532. Thus, +5 v is available for all logic components and the microprocessor is activated to assert an output referred to as "power hold" which is applied at line 536 to forward bias diode D13 and maintain switch 524 in an actuated or "on" condition.

Referring additionally to FIG. 15B, the earlier-described microprocessor is revealed with the same numeration at 230. Processor 230 performs in conjunction with a crystal containing oscillator network represented generally at 550. Network 550 is connected through capacitors C22 and C23 to the ground connection line 552 of reset start device 554, provided, for example, as a type MC33064D-5. A reset output of device 554 at line 556 is asserted via line 558 to the reset input of microprocessor 230 and performs in conventional fashion to start-up the device 230 upon the application of +5 v to device 554 via line 560.

The EEPROM device earlier-described at 232 in FIG. 8 is shown in the instant figure with the same identifying numeration as being connected to the PD terminals of device 230 through line array 562. One line of array 562 is seen at line 564 extending through a NAND inverter 566, line 568, and resistor R41 to provide an LCD reset signal. Line array 570 is shown coupled to the PC terminals of device 230 and line array 572 is seen coupled to its PB terminals. Earlier-described line 514 carrying serial data is shown extending through Schmitt inverter 574 to a terminal of the PD ports of device 230 as is the data out or transmission signal at line 492. Line 536 carries the power hold signal from the PA terminal of device 230, while LCD SB signal and buzzer on outputs are provided from device 230 from respective lines 576 and 578. A buzzer volume control signal is asserted from the device 530 from line 580. An LCD ready input is asserted from that function to the device 230 via line 582, and a four line array 584 connects the PE terminals of device 230 with the switching circuit for the monitor.

Referring additionally to FIG. 15C, the circuit continues, lead or line arrays 570 and 572 being shown extending to a bus 586 which, in turn, addresses EPROM 240. Device 240 has been described earlier and may be provided, for example, as a type AM27C512-200PC having its D terminal outputs at line array 588 and its chip enable (CE) terminal coupled through resistor R42 to the output of a Schmitt inverter 590, the input of which extends to bus 586 from OR function diode array 592. The bus 586 further extends to random access memory as described earlier at 236 and represented by the same numeration herein.

An address latch network is provided at 594 as comprised of NAND components 596–598, device 597 having one input extending from a Schmitt inverter 600. A latch provided, for example as a type 74HC573, is provided at 602 in connection with bus 586. Finally, connectors are represented in the figure at 604–606.

Figure 16A:
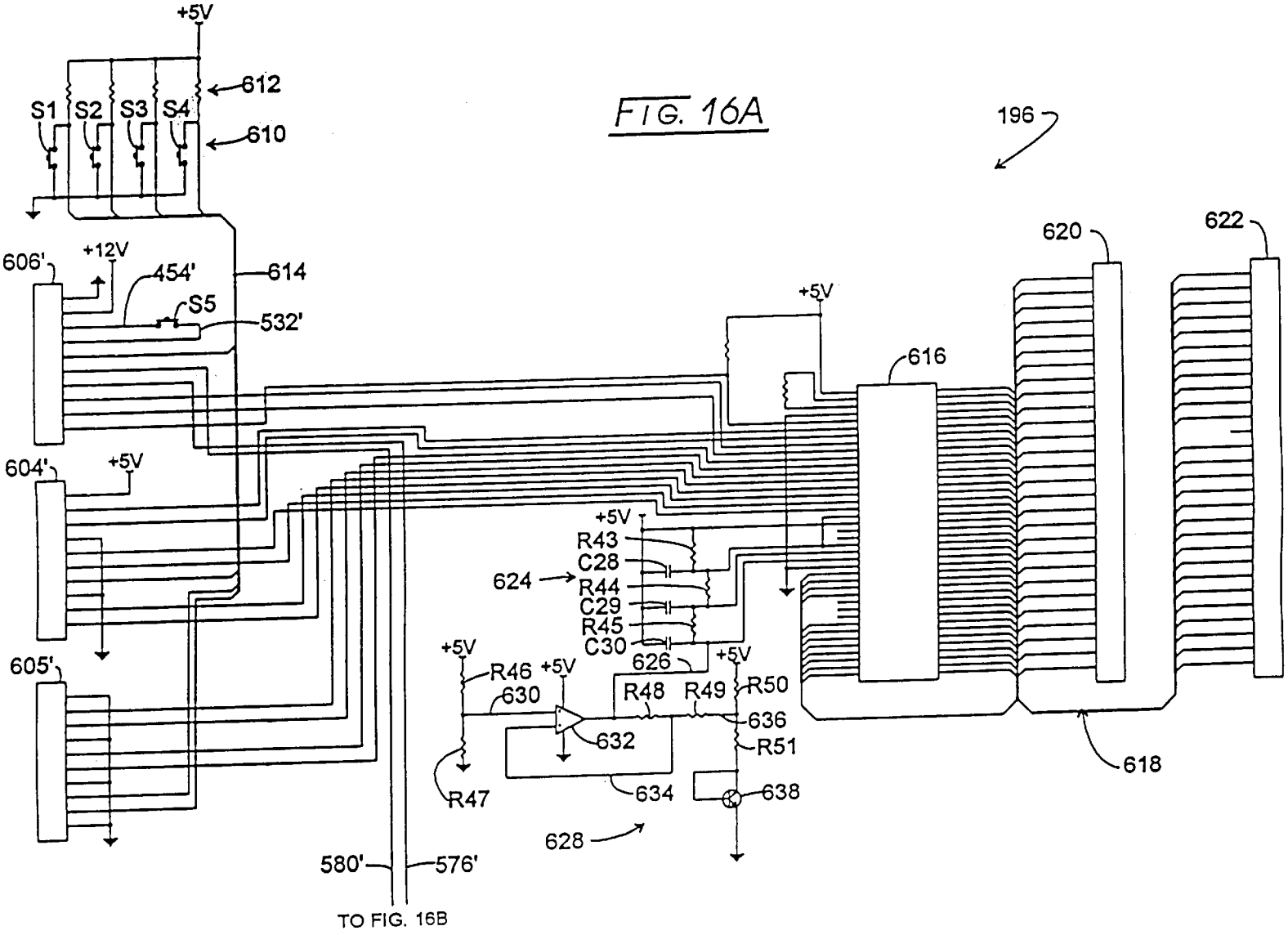
FIGS. 16A and 16B combine as labeled thereon to describe additional circuitry employed with the monitoring system of the invention.
Figure 16B:
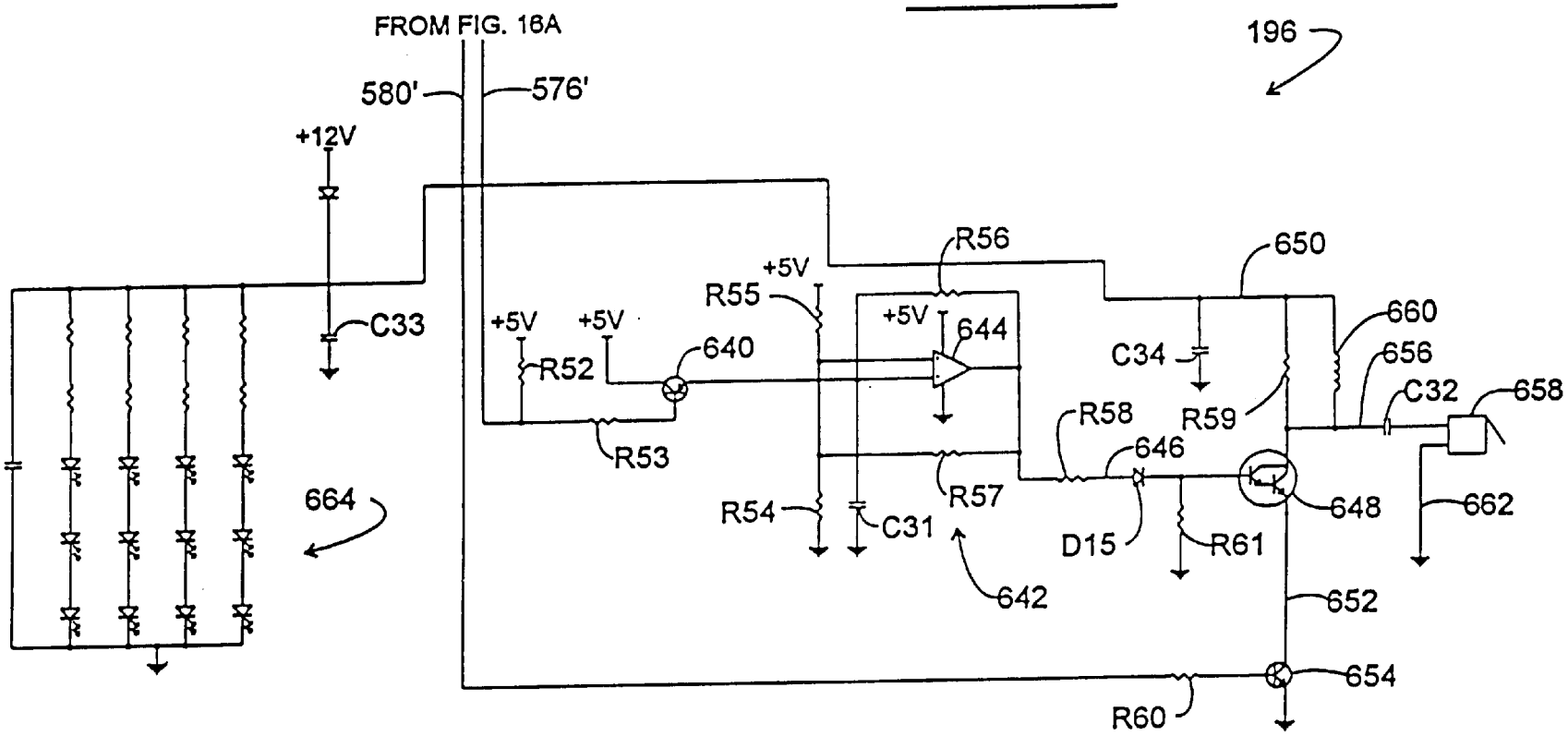

Looking additionally to FIG. 16A, those connectors corresponding with connectors 604–606 are represented in primed fashion. FIG. 16A reveals a switching network 610 with switches S1–S4 coupled through a resistor network 612 to +5 v. These momentary, manually actuated switches correspond with switches 299–302 described in connection with FIG. 9. The outputs of the switches are shown extending to a four line database 614. Looking in particular to the connector 606', it may be seen that the power on and off switches S5 corresponding with switch 298 shown in FIG. 9 is coupled to interconnect line 454 and line 532 as earlier described. These lines are shown, respectively, in primed fashion in FIG. 16A. Connector 604' connects address driver and enable functions for liquid crystal display (LCD) controller 626. Controller 616 may be provided, for example, as a type HD61602 and is coupled via a bus arrangement 618 to connector components 620 and 622 which are intended for connection with a conventional LCD display. Connector 604' additionally provides +5 v supply to the circuitry shown in FIGS. 16A and 16B as well as an output for switch S3. Correspondingly, connector 605' provides outputs for switches S1 and S2 as well as address inputs to the controller 616.

Controller 616 works in conjunction with intermediate voltage levels. These voltage levels are established by a divider network 624 shown comprised of capacitors C28–C30 and corresponding resistors R43–R45. Network 624 as connected via line 626 extends to a temperature compensation network represented at 628. Network 628 is comprised of divider resistors R46 and R47 which are tapped at line 630 and directed to the input an operational amplifier 632. The opposite input to device 632 at line 634 extends to its output line 636 intermediate resistors R48 and R49. Line 636, in turn, extends intermediate resistors R50 and R51 which, in turn, extend to the collector and base of NPN transistor 638, the emitter of which extends to ground. Because the display of the monitor is subjected to wide ranges of temperatures, the network 628 provides for such compensation as to facilitate the reading of this instrument throughout all temperature zones and seasons of weather during which concrete pavement is produced.

FIG. 16A further reveals that connector 606' carries the extensions of lines 576 and 580 representing, respectively, the on condition for an annunciator or buzzer as well as the volume control therefrom. It may be recalled that the latter volume control extended from line 580 described in conjunction with FIG. 15B, line 576 being positioned in that figure at a next adjacent location.

These buzzer actuation and control lines 576' and 580' are seen to reappear in FIG. 16A. Referring to that figure, it may be observed that line 576' extends through resistors R52 and R53 to the gate of PNP transistor 640. Device 640 performs an on-off function for the purpose of activating an oscillator network represented generally at 642. This provides flexibility in the type sound produced, i.e. continuous, single beep, or repetitive pulse. Network 642 is configured in conventional fashion with an operational amplifier 644 operating in conjunction with capacitor C31 and resistors R54–R58. The oscillative output of network 642 at line 646 is directed through a diode D15 to the input of NPN Darlington transistor pair 648. The collector of device 648 is coupled through resistor RS9 to +12 v at line 650, while the emitter thereof is coupled via line 652 to a volume control NPN transistor 654, the base of which is coupled through resistor R60 to line 580'.

Line 656 functions to drive a piezoelectric transducer 658 through a coupling capacitor C32. An inductor 650 accommodates for feedback spikes, while the opposite input to device 658 is coupled to ground through line 662. Within the overall circuitry, filtering capacitors are provided as seen C33 and C34, while a pull-down resistor is provided at the gate of device 648 shown at R61.

Finally, an LED network is represented at 664 coupled with line 650. Network 664 provides back lighting for the LCD device connected with the connectors 620 and 622 (FIG. 16A).

Figure 17B:
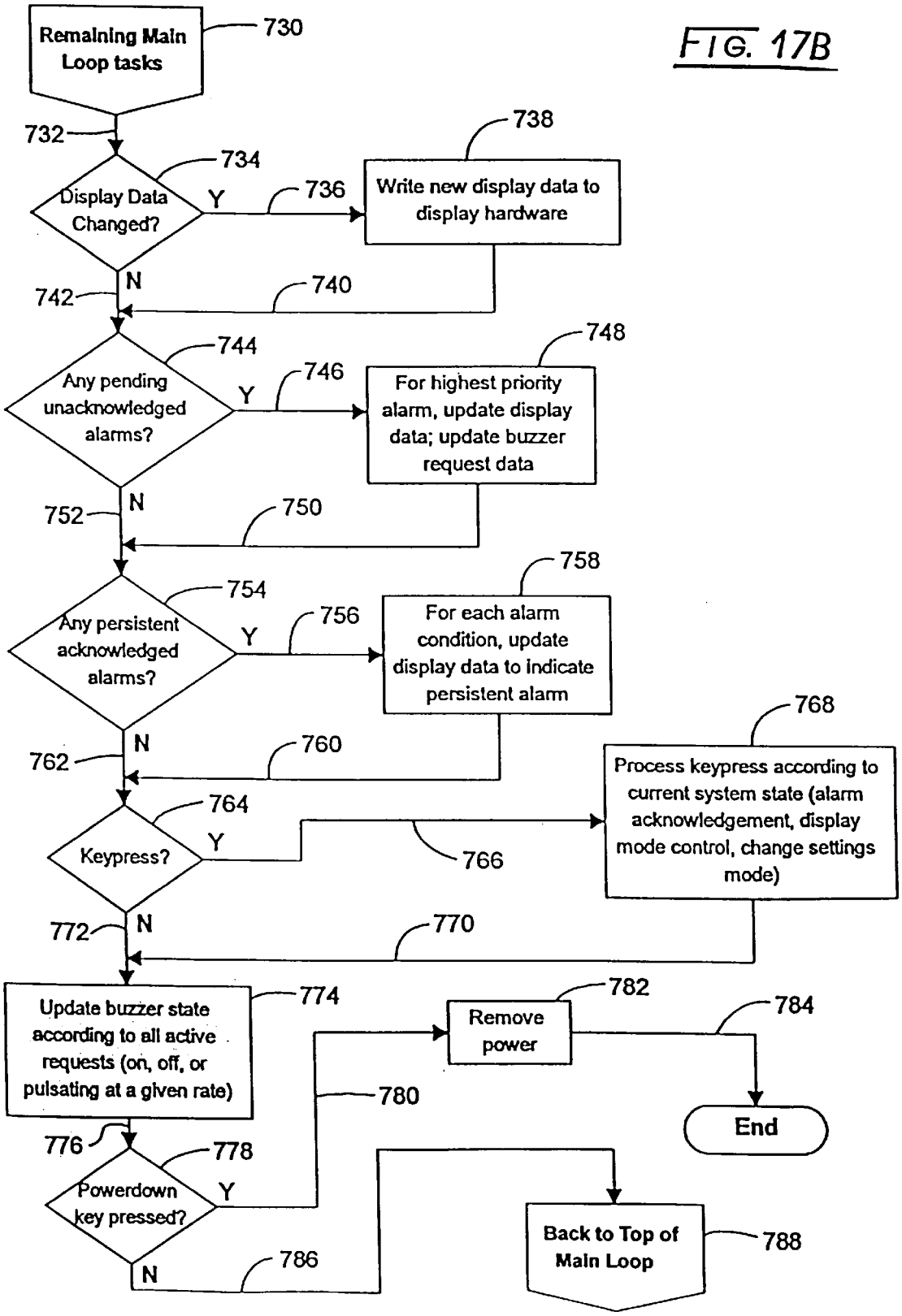

Referring to FIGS. 17A and 17B, a main loop for a program controlling the operation of the monitor with respect to vibrator rate performance data is revealed. Looking to FIG. 17A, the program commences as represented at block 670 with a start activation. In this regard, a pushing of the power switch of the monitor will commence such activities. Then, as represented at line 672 and block 674, conventional microprocessor-based initialization procedures are carried out. Following initialization, as represented at line 676 and block 678, a determination is made as to whether the system is in a learn mode. In a learn mode, the program will provide a global polling requesting the manufacturer's serial number of each of the accelerometers within the system. The type of accelerometer utilized will respond to this global command as it is connected into the system harness. As this activity ensues, then the program will assign that particular accelerometer installation a unique polling number or position. Accordingly, as represented at line 680 and block 682, where a learn mode is at hand, as each accelerometer assembly is plugged into the harness or system, the serial number is collected and stored in non-volatile memory and a polling position number is assigned. The program then continues as represented at line 684 and block 686 to commence the main loop of the program.

Where the query posed at block 678 results in a determination that a learn mode is not at hand, then, as represented at line 688 and block 690, the accelerometer assemblies are awakened and assigned polling numbers. The program then continues as represented at line 692 to the start of the main loop as represented at block 686. In general, the operator may induce the learning mode by pressing down certain of the keys of the monitor, for example, a simultaneously pressing of the acknowledge, down and mode switches will bring the monitor into a learn mode condition. In general, the display of the monitor provides for prompting of this procedure.

In the general program, tasks are split or spliced such that communications will be interspersed for time conservation with other such activities as updating the display, testing for key presses, and the like. Accordingly, as represented at line 694 and block 696, the program initially determines whether any outgoing message is in progress. Additionally, it may be borne in mind that the data accumulated from the accelerometer installations is recovered on a polling basis. Where the determination is made that an outgoing message is in process, then as represented at line 608 and block 700, the message continues to be transmitted and as represented at line 702 and block 704, a query is made as to whether the outgoing message has been completed. Where it has not been completed, the program continues as represented at line 706. On the other hand, where the outgoing message has been completed, then as represented at line 708 and block 710 a responding message will have been encountered and is in progress and the program continues as represented at line 712.

Returning to block 696, where a determination is made that an outgoing message is not in progress, then as represented at line 714 and block 716, a dialog based assumption is made that a message is being received and as represented at line 718 and block 720, a determination is made as to whether the entire message has been received. Where it has not, then as represented at line 722, the program progresses. On the other hand, where a determination that an entire message has been received, then as represented at line 724 and block 726, any new incoming message is processed and the program continues as represented at line 728. The main loop then continues as represented at node 730.

Node 730 continues as shown in FIG. 17 with a node having the same numerical identification and line 732. Line 732 extends to block 734 and a determination as to whether display data has been changed. Generally, the spontaneity required for display change for the present application is slower than in other industrial processes. However, it may be observed that the alteration of a display involves a substantial amount of processor and display controller activity. Even though display data may have been changed for the instant system, that change is made in random access memory as opposed to being immediately written into the display itself. As a consequence, to enhance efficiency in view of the lengthier intervals for change available, the display is changed incrementally in terms of each computer cycle. Where the data has changed, then as represented at line 736 and block 738, new display data is written to the display, and the program continues as represented at lines 740 and 742. Where no change in display data has been effected, then as represented at block 744, a determination is made as to whether any unacknowledged alarms are pending in the system. As above, these unacknowledged alarms may be represented as data residing in random access memory as opposed to being displayed pending further data. Accordingly, where there is an unacknowledged alarm, as represented at line 746 and block 748, the display data is updated as well as the buzzer request data is updated for the highest priority of one of the alarms. The program then continues as represented at lines 750 and 752. Where the determination at block 744 is in the negative, then as represented at line 752 and block 754, a determination is made as to whether any acknowledged alarms persist. Where such an alarm does persist, then as represented at line 756 and block 758, the display data is updated to indicate a persistent alarm and the program continues as represented at lines 760 and 762. Where no acknowledge alarm persists, then as represented at line 762 and block 764, a determination is made as to whether there has been a switch actuation of the monitor, i.e. a key press. Where such an actuation has occurred, then as represented at line 766 and block 768, the system processes that key press according to the state of the system, i.e. alarm acknowledgement display mode control or change in settings mode. The program then continues as represented at lines 770 and 772. Where the determination at block 764 is that no key has been pressed, then as represented at line 772 and block 774, the buzzer state (aural alarm) is updated according to all active requests. The buzzer may be on or off or continuously buzzing, or may beep or pulsate at some given rate. The program then continues as represented at block 778 wherein a determination is made as to whether the power down key has been pressed. The power up and power down features have been discussed above in connection with FIG. 15A and the key at hand is that described at 298 in FIG. 9. Where that key has been pressed, then as represented at line 780 and block 782, power is removed and as represented at line 784, the program ends. Where no power key depression has been witnessed, then as represented at line 786 and node 788, the program returns to the main loop.

The principal data derived by the system is that of the rate of vibration or vibrations per minute, which for the rotating eccentric mechanisms of typical vibrators may be related as revolutions per minute (RPM). While the user will wish to have alarm data as to when those rate values extend above or fall below respective limits or thresholds of operation, it must be observed that the systems are turned off and on with regularity. It is not the desire of the users to evoke an alarm condition with buzzers and display outputs when the slip paver is simply powering up or powering down. The present system recognizes those normal transitional conditions in software. In general, while the system responds quickly to an alarm condition, it does so within procedure. Upon the occasion of an RPM base alarm, the premise of the system is that one vibrator has exceeded a limit or fallen below a threshold. Further analysis then is carried out. As a prelude to considering this analysis, process definitions have been developed. In this regard, vibrations per minute (VPM) or revolutions per minute (RPM) are categorized as follows:

(1) NEARLYZERORPM<VERYLOW RPM<LOWRPM (2) any state changes out of a "PENDING" stage also require that trigger conditions persist for a minimum time.

Figures 18A, 18B:
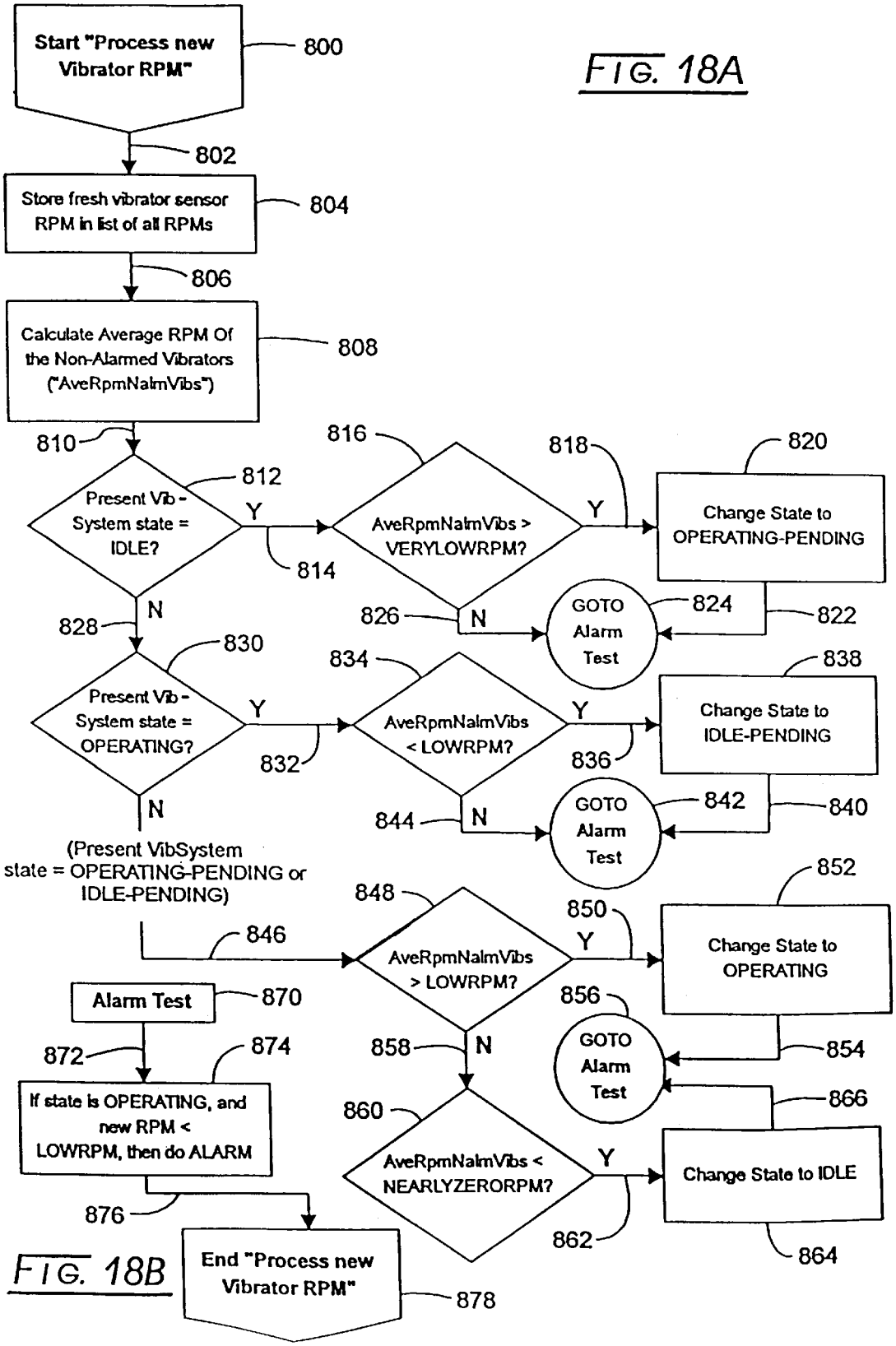
FIGS. 18A and 18B describe subroutines which may be employed with the main program represented by FIGS. 17.

With the above in mind, reference is made to FIG. 18 wherein the RPM (VPM) processing program is analyzed. This program commences with node 800 where the program processes a newly received RPM or VPM value. In effect, the system will have received a response to a sensor call and there will have been returned a period of vibration which is turned into RPM or VPM a straightforward mathmatical transformation. This incoming message is described in connection with FIG. 17A at block 726. Accordingly, as represented in FIG. 18 at line 802 and block 804, the fresh message or vibrator sensor RPM is stored and there then exists and updated list of all RPM valuations. Next, as represented at line 806 and block 808, calculation is made of the average RPM of the non-alarmed vibrator (AveRpmNalmVibs). Those average values, in effect, are related to healthy vibrators.

Within the system, two basic states of operation are devised, to wit, "idle" and "operating". The remainder of the flow diagram involves the management of the system with respect to transitions between those two stages. For an idle state, it appears to the system that a given vibrator representing that idle state is shut down. In general, when the system is in an idle state, it is awaiting a valid reason for transition into an operating state. On the other hand, when the system is in an operating state, it is awaiting a valid reason for transition into an idle state. The term "Vibsystem" is a term representative of the state of all vibrators of the system.

Returning to the flow chart, following the calculation of average RPM as represented at block 808, then the program continues as represented at line 810 and block 812 to determine whether the present Vibsystem is IDLE. The IDLE state represents an intermediate interval in start-up or in shut-down of the system. In the event that an idle state is at hand, then as represented at line 814 and block 816, a determination is made as to whether the average RPM of the non-alarm vibrators is greater than the value for VERYLOWRPM. This determination is made to provide an initial valuation as to whether the system has commenced to be turned on. Where the relationship posed at block 816 is true, then as represented at line 818 and block 820, the system changes the state condition to one of "OPERATING-PENDING" (operating transient) The "OPERATING-PENDING" state is an intermediate one wherein the system is waiting to see if a change of state is underway. In effect, four states are involved in the program which may be listed as: "IDLE", "OPERATING", "OPERATING-PENDING" or transient and "IDLE-PENDING" or transient. As represented at line 822 and circle 824, the system tests for the existence of any alarms. Correspondingly, where the average RPM of all non-alarm vibrators is not greater than the VERYLOW RPM value, then as represented at line 826, the system tests for the existence of alarm conditions representing a functioning vibrator or vibrators.

Returning to block 812, where the idle state is not present, then as represented at line 828 and block 830, a determination is made as to whether the present Vibsystem is "OPERATING". When an OPERATING state is at hand, then as represented at line 832 and block 834, a determination is made as to whether the average RPM of non-alarmed vibrators is less than the value of LOWRPM. Where that condition is true, then as represented at line 836 and block 838, the state of the system is changed to the transitional state: "IDLE-PENDING". The program then diverts to an alarm test as represented at line 840 and circle 842. On the other hand, where the average RPM of non-alarm vibrators is not less than the LOWRPM value, then as represented at line 844, the alarm test is carried out as represented at circle 842. In effect, each time a new RPM or vibrator input is received, a test is made to determine whether the system is operating and if it is, then an alarm test is carried out on the vibrator subject of the data inclusion. False alarms are avoided with the arrangement No alarms are published in the presence of the transitional states: OPERATING-PENDING and IDLE-PENDING.

Returning to block 830, where the present vibrator system state is not categorized as "OPERATING", then as represented at line 846 and the statement presented thereat, the present vibrating system is either "OPERATING-PENDING" or "IDLE-PENDING". Then, as represented at block 848, a determination is made as to whether the average RPM of the no-alarm vibrators is greater than the low threshold value, LOWRPM. Where that is the case, then as represented at line 850 and block 852, the state of the system is designated as "OPERATING". As represented at line 854 and circle 856, the alarm test is carried out. Even though the OPERATING state is valid in terms of the test at block 848, one vibrator may be defective while the average remains valid. Thus, the system will test for alarm conditions at this point while validating an operating state. Where the determination at block 848 is that the average RPM of the non-alarm condition vibrators is not greater than the value of LOWRPM, then as represented at line 858 and block 860, a determination is made as to whether the average RPM of the non-alarmed vibrators is less than the value of NEARLYZERORPM. Where that is the case, then a ramping down to shut-off of the system may be at hand and as represented at line 862 and block 864, the state of the system is changed to IDLE. However, to ensure the validity of all vibrators, as represented at line 866 and circle 856, the alarm test again is carried out. The program then returns to the remaining loop test node 730 in connection with FIG. 17B Referring to FIG. 18B, the alarm test described in connection with circles 824, 842, and 856 is illustrated. The test commences as represented at block 870 and line 872 to the instructions at block 874. At that position, a determination is made that if a state is operating and new RPM data is available, that new RPM data is tested with respect to determining whether it is less than the value of LOWRPM. Where that is the case, an alarm is carried out. The program then continues as represented at line 876 and node 878. The same form of alarm test may be carried out with respect to an alarm limit value for excessive RMP or VPM of a given vibrator. This will be at the option of the user.

Since certain changes may be made in the above-described apparatus, system and method without departing from the scope of the invention herein involved, it is intended that all matter contained in the description thereof or shown in the accompanying drawings shall be interpreted as illustrative and not in a limiting sense.

We claim:

1. In a concrete paving system wherein a supporting frame is moved along a path over which concrete pavement is to be formed, having a spreading mechanism supported by said frame confronting supplied concrete for providing distributed concrete, spaced apart vibrators from first to last supported by said frame and each exhibiting a given period of vibration, located within said distributed concrete to provide consolidated concrete, a mold apparatus supported by said frame for receiving said consolidated concrete and providing molded concrete, the improvement comprising:

accelerometers from first to last respectively mounted in vibration transfer relationship with respective said vibrators from first to last and having respective first to last acceleration signals corresponding to the vibration exhibited by a said vibrator with which each is operationally associated;

a vibration conversion network coupled for response to said first to last acceleration signals for deriving respective first to last conversion outputs corresponding with said given periods of vibration; and a monitor assembly, including a monitor controller mounted upon said frame, responsive to said first to last conversion outputs for deriving rate output signals from first to last corresponding respectively with the rate of vibration of each said vibrator from first to last, and a display responsive to said rate output signals for providing a visual readout corresponding therewith.

2. The concrete paving system of claim 1 in which:

said vibration conversion network includes first to last local vibration circuits coupled with respective first to last said accelerometers, each one of said local vibration circuits including a local signal treatment network for relating an applied said acceleration signal with a reference to derive a local period related signal as one said first to last conversion output.

3. The concrete paving system of claim 2 in which said local signal treatment network includes a comparator stage for deriving said local period related signal as serial pulses.

4. The concrete paving system of claim 2 in which:

each said local vibration circuit includes a local controller responsive to a first polling actuation input to transmit an accelerometer related unique identifier at an output thereof, and responsive to a second polling actuation input and said local period related signals to transmit said corresponding conversion outputs at a said output; and said monitor controller is actuable to derive said first polling input to receive a said accelerometer related identifier, and is responsive to derive said second polling actuation with respect to said unique identifier.

5. The concrete paving system of claim 4 in which said monitor controller is responsive in a learn mode to effect said first polling actuation and is responsive in a wake-up mode to derive said second polling actuation, said second polling actuation assigning a unique first to last polling identifier corresponding with an associated said accelerometer related unique identifier.

6. The concrete paving system of claim 1 including:

at least one said vibration signal treatment network responsive to said first to last acceleration signals for deriving mechanical vibration analysis signals therefrom in digital format; and said monitor assembly includes memory for receiving and retaining said mechanical vibration analysis signals.

7. The concrete paving system of claim 1 including:

at least one vibration probe, mounted upon said frame and extensible within said distributed concrete in spaced adjacency with a said vibrator and having a vibration transducer mounted therewith responsive to vibration phenomena within said distributed concrete for providing a vibration probe signal corresponding therewith; and a vibration signal treatment network responsive to said probe vibration signal for deriving a consolidation analysis signal in correspondence therewith.

8. The concrete paving system of claim 7 in which said monitor assembly includes memory for receiving and retaining said consolidation analysis signal.

9. The concrete paving system of claim 1 including:

an extrinsic data input assemblage for deriving extrinsic signals corresponding with the speed of movement of said frame, calendar data, time data and ambient temperature data; and said monitor assembly includes memory for receiving and retaining said extrinsic signals.

10. The concrete paving system of claim 1 in which said monitor controller is responsive to derive an alarm condition when a said rate output signal exhibits an alarm value less than a first threshold value, is responsive to derive an average value of said rate output signals from first to last with the exclusion of any said rate output signal exhibiting a said alarm value, is responsive to derive an operating transition state when said average value is greater than a second threshold value less than said first threshold value, is responsive to derive an operating state when said average value is greater than said first threshold value in the presence of said operating transition state, and is responsive to display said alarm condition at said display with respect to any said excluded rate output signal in the presence of said derived operating state.

11. The concrete paving system of claim 1 in which said monitor controller is responsive to derive an alarm condition when a said rate output signal exhibits an alarm value less than a first predetermined threshold value, is responsive to derive an average value of said rate output signal from first to last with the exclusion of any said rate output signal exhibiting a said alarm value, is responsive to derive an idle transition state when said average value is less than said first threshold value, is responsive to derive an idle state when said average value is less than a third threshold value less than said second threshold value in the presence of said idle transition state, and is responsive to announce said alarm condition at said display in the presence of said derived idle state.

12. The concrete paving system of claim 1 in which said monitor controller is responsive to derive a high vibration alarm condition when a said rate output signal exhibits a high alarm value greater than a predetermined limit value, and is responsive to display said high vibration alarm condition at said display.

13. The concrete paving system of claim 1 in which:

said paving system includes a dowel bar insertion assembly having a dowel vibrator coupled therewith exhibiting a given period of vibration for facilitating the insertion of dowels within said molded concrete;

including a bar insertion related accelerometer mounted in vibration responsive relationship with said dowel vibrator and having an insertion assembly acceleration signal corresponding to the vibrations exhibited by said dowel vibrator;

said vibration conversion network is coupled for response to said insertion assembly acceleration signal for deriving insertion assembly conversion outputs corresponding with said dowel vibrator given period of vibration; and said monitor controller is responsive to said insertion assembly conversion outputs for deriving insertion assembly rate output signals corresponding with the rate of vibration of said dowel vibrator, and said display is responsive to said insertion assembly rate output signals for providing a visual readout corresponding therewith.

14. A method for monitoring the performance of a concrete paving system wherein a frame is moved along a path over which concrete pavement is to be formed, having a spreading mechanism supported by said frame confronting supplied concrete for providing distributed concrete, spaced apart vibrators from first to last supported by said frame and each exhibiting a given period of vibration, located within said distributed concrete to provide consolidated concrete, a mold apparatus supported by said frame for receiving said consolidated concrete and providing molded concrete, comprising the steps of:

providing vibration responsive transducers from first to last respectively mounted in vibration transfer relationship with respective said vibrators from first to last and having respective first to last transducer signals corresponding to a select vibration parameter exhibited by a said vibrator with which each is operationally associated;

providing a conversion network coupled for response to said first to last transducer signals for deriving respective first to last conversion outputs corresponding with said given periods of vibration;

deriving first to last rate output signals respectively corresponding with said first to last conversion outputs; and displaying a readout of first to last vibration rate values corresponding with respective said first to last rate output signals.

15. The method of claim 14 including the steps of:

providing a first threshold value for said vibration rate values;

establishing an alarm condition status for a said vibration rate value corresponding with a said first to last transducer which is lower than said first threshold value;

deriving an average value for said first to last vibration rate values excluding said vibration rate value representing said alarm condition status;

determining an operating transition state when said average value is greater than a second threshold value less than said first threshold value;

determining an operating state when said average value is greater than said first threshold value in the presence of said operating transition state; and displaying an alarm condition with respect to said excluded conversion output in the presence of said operating state.

16. The method of claim 15 including the steps of:

determining an idle transition state when said average value is less than said first threshold value; and determining an idle state when said average value is less than a third threshold value less than said second threshold value in the presence of said idle transition state.

17. The method of claim 14 including the steps of:

establishing a high vibration alarm condition when a said conversion output exhibits a high alarm value greater than a predetermined limit value; and displaying said high vibration alarm condition.

18. The method of claim 14 including the steps of:

providing a vibration probe within said distributed concrete in spaced adjacency with a said vibrator;

providing a vibration transducer with said vibration probe responsive to vibration phenomena within said distributed concrete and having a vibration probe signal;

treating said vibration probe signal to derive a consolidation analysis signal corresponding therewith; and retaining said consolidation analysis signal in memory.

19. The method of claim 18 in which:

said vibration transducer is an accelerometer and said vibration probe signal is a vibration acceleration signal;

including the step of:

selectively integrating said acceleration signal to derive said consolidation analysis signal.

20. The method of claim 14 in which:

said vibrators from first to last are provided including eccentric-configured shafts rotatably supported by bearings and hydraulically rotatably driven to produce said vibration;

said first to last vibration responsive transducers are provided as accelerometers deriving said first to last transducer signals as respective first to last vibration acceleration signals;

including the steps of:

treating said first to last acceleration signals to derive respective first to last bearing condition signals; and submitting said bearing condition signals to memory.

21. In a concrete paving system wherein a supporting frame is moved along a path over which concrete pavement is to be formed, having a spreading mechanism supported by said frame confronting supplied concrete for providing distributed concrete, spaced apart vibrators from first to last, each incorporating bearings mounting a rotational eccentric driven by a seal containing hydraulic drive assembly, each said vibrator exhibiting a given period of vibration and located within said distributed concrete to provide consolidated concrete, a mold apparatus supported by said frame for receiving said consolidated concrete and providing molded concrete, the improvement comprising:

vibration transducers from first to last respectively mounted in vibration transfer relationship with respective said vibrators from first to last and having first to last transducer signals corresponding to the vibration exhibited by a said vibrator with which each is associated;

a conversion circuit coupled for response to said first to last transducer signals for deriving respective first to last conversion outputs corresponding with a said given period of vibration; and a monitor assembly including a monitor controller mounted upon said frame, responsive to said conversion outputs for deriving rate output signals from first to last, respectively, corresponding with the rate of vibration of each said vibrator from first to last, responsive to derive an alarm condition when a said rate output signal exhibits an alarm value less than a predetermined threshold value, said monitor assembly including a display responsive to said rate output signals and to the occurrence of a said alarm condition for providing visual readouts corresponding therewith.

22. The concrete paving system of claim 21 in which said monitor controller is responsive to derive a high vibration alarm condition when a said rate output signal exhibits a high alarm value greater than a predetermined limit value; and is responsive to effect display of said high vibrator alarm condition at said display.

23. The concrete paving system of claim 21 in which:

said first to last vibration responsive transducers are accelerometers deriving said first to last transducer signals as respective first to last vibration acceleration signals;

including a signal treatment network for deriving respective first to last bearing condition signals relating to the operational status of said bearings; and said monitor assembly includes memory for retaining said bearing condition signals.

24. The concrete paving system of claim 21 including:

at least one vibration probe, mounted upon said frame and extensible within said distributed concrete in spaced adjacency with a said vibrator and having a vibration transducer mounted therewith responsive to vibration phenomena within said distributed concrete for providing a vibration probe signal corresponding therewith; and a vibration signal treatment network responsive to said vibration probe signal for deriving a consolidation analysis signal in correspondence therewith.

25. The concrete paving system of claim 24 in which said monitor assembly includes memory for receiving and retaining said consolidation analysis signal.

* * * * *